US012668909B2

(12) United States Patent
Xiong et al.

(10) Patent No.: US 12,668,909 B2
(45) Date of Patent: Jun. 30, 2026

(54) CLOTHING TREATMENT DEVICE

(71) Applicant: WUXI LITTLE SWAN ELECTRIC CO., LTD., Wuxi (CN)

(72) Inventors: Lining Xiong, Wuxi (CN); Yacheng Shi, Wuxi (CN); Jia Wang, Wuxi (CN)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 93 days.

(21) Appl. No.: 18/638,951

(22) Filed: Apr. 18, 2024

(65) Prior Publication Data

US 2025/0283265 A1 Sep. 11, 2025

(30) Foreign Application Priority Data

Mar. 6, 2024 (CN) ..... 202410254976.5

(51) Int. Cl.
*D06F 37/24* (2006.01)
*D06F 37/26* (2006.01)

(52) U.S. Cl.
CPC ..... *D06F 37/24* (2013.01); *D06F 37/268* (2013.01)

(58) Field of Classification Search
CPC ..... D06F 37/24; D06F 37/268
See application file for complete search history.

(56) References Cited

U.S. PATENT DOCUMENTS 9,809,919 B2 11/2017 Yu
9,915,018 B2 3/2018 Kim
11,035,065 B2 6/2021 Yu
11,427,949 B2 8/2022 Han
2011/0167878 A1* 7/2011 De Angelo Sanchez ..... D06F 37/268 68/212
2014/0060120 A1 3/2014 Yu
2016/0369444 A1* 12/2016 Kim ..... D06F 37/268
2017/0183802 A1* 6/2017 Yu ..... D06F 37/24
(Continued)

FOREIGN PATENT DOCUMENTS

CN 103215785 A 7/2013
CN 104294539 A 1/2015
(Continued)

OTHER PUBLICATIONS

Machine translation of CN 117403417 A to Chen et al. (Year: 2024).*
(Continued)

*Primary Examiner* — Joseph L. Perrin
(74) *Attorney, Agent, or Firm* — Scully, Scott, Murphy & Presser, P.C.

(57) ABSTRACT

A clothing treatment device is provided. The device includes a housing, a tub assembly and a damping assembly. The damping assembly includes a first movement member and a second movement member connected to each other. An end of the first movement member away from the second movement member is connected to the tub assembly. An end of the second movement member away from the first movement member is connected to a component out of the tub assembly. The first movement member and the second movement member are relatively rotatable around a joint. An axis, around which the first movement member and the second movement member rotate relatively, is substantially parallel to an axis of the tub assembly.

15 Claims, 16 Drawing Sheets

(56) References Cited

U.S. PATENT DOCUMENTS

| | | | | |
|---|---|---|---|---|
| 2018/0142403 | A1* | 5/2018 | Han | D06F 37/20 |
| 2021/0172106 | A1* | 6/2021 | Han | D06F 23/04 |

FOREIGN PATENT DOCUMENTS

| | | | | | |
|---|---|---|---|---|---|
| CN | 108166212 | A | | 6/2018 | |
| CN | 207919165 | U | | 9/2018 | |
| CN | 108691146 | A | | 10/2018 | |
| CN | 109208254 | A | | 1/2019 | |
| CN | 109306601 | A | | 2/2019 | |
| CN | 109778494 | A | | 5/2019 | |
| CN | 111172713 | A | | 5/2020 | |
| CN | 218232845 | U | | 1/2023 | |
| CN | 117403417 | A | * | 1/2024 | D06F 37/24 |
| CN | 117403418 | A | * | 1/2024 | D06F 37/24 |
| JP | S59-212548 | A | | 12/1984 | |
| JP | H11-351317 | A | | 12/1999 | |
| KR | 10-2004-0058726 | A | | 7/2004 | |
| KR | 10-2016-0026933 | A | | 3/2016 | |
| KR | 10-2016-0029519 | A | | 3/2016 | |
| KR | 10-2016-0130695 | A | | 11/2016 | |

OTHER PUBLICATIONS

Machine translation of CN 117403418 A to Wang et al. (Year: 2024).*

International Search Report dated Jun. 19, 2025 received in International Application No. PCT/CN2025/081012.

Written Opinion dated Jun. 19, 2025 received in International Application No. PCT/CN2025/081012.

International Search Report dated May 20, 2025 received in International Application No. PCT/CN2025/081019.

Written Opinion dated May 20, 2025 received in International Application No. PCT/CN2025/081019.

International Search Report dated Dec. 4, 2024 received in International Application No. PCT/CN2024/090203.

Written Opinion dated Dec. 4, 2024 received in International Application No. PCT/CN2024/090203.

International Search Report dated Dec. 4, 2024 received in International Application No. PCT/CN2024/090201.

Written Opinion dated Dec. 4, 2024 received in International Application No. PCT/CN2024/090201.

* cited by examiner

CLOTHING TREATMENT DEVICE

FIELD

The disclosure relates to the field of clothing treatment, and in particular to a clothing treatment device.

BACKGROUND

A pulsator clothing treatment device is taken as an example; in case that an external size of a housing is unchanged, a gap between a tub assembly and the housing becomes smaller and smaller with the increase of a washing volume. During washing or spin-drying, the tub assembly may vibrate in a horizontal direction and in a height direction, so that the tub assembly is prone to hitting the housing, which affects safety of the clothing treatment device during operation.

In order to reduce vibration of the tub assembly in the horizontal direction, the clothing treatment device can be provided with a damper, an end of the damper is connected to the tub assembly, another end of the damper is connected to a suspender, and when the tub assembly vibrates, the damper moves with the tub assembly to dissipate vibration energy. However, a movement axis of the damper is parallel to the horizontal direction, therefore the damping effect on horizontal vibration of the tub assembly is unsatisfactory.

SUMMARY

In view of this, it is desirable for embodiments of the disclosure to provide a clothing treatment device, in which horizontal vibration of the tub assembly is absorbed effectively, to reduce a probability of the tub assembly hitting the housing.

An embodiment of the disclosure provides a clothing treatment device, and the clothing treatment device includes a housing, a tub assembly, and a damping assembly.

The tub assembly is arranged in the housing.

The damping assembly includes a first movement member and a second movement member connected to each other, an end of the first movement member away from the second movement member is connected to the tub assembly, and an end of the second movement member away from the first movement member is connected to a component out of the tub assembly.

The first movement member and the second movement member are relatively rotatable around their joint, and an axis around which the first movement member and the second movement member rotate relatively is substantially parallel to an axis of the tub assembly.

In some implementations, a first end of the first movement member may be connected to a first end of the second movement member, and an angle between a line connecting centers of first and second ends of the first movement member and a line connecting centers of first and second ends of the second movement member does not exceed 180°.

In some implementations, a first end of the first movement member may be connected to a first end of the second movement member, and when the tub assembly is in a stationary state, an angle between a line connecting centers of first and second ends of the first movement member and a line connecting centers of first and second ends of the second movement member is not less than 50° and does not exceed 120°.

In some implementations, a position where the first movement member is connected to the tub assembly may be a first position, a position where the second movement member is connected to the component out of the tub assembly may be a second position, and in a planar projection perpendicular to a height direction of the clothing treatment device, when the tub assembly is in a stationary state, a line connecting centers of projections of the first position and the second position is substantially perpendicular to a tangent line of the tub assembly at the first position.

In some implementations, the clothing treatment device may include a first rod and a second rod, the first rod is fixed to an outer circumferential side of the tub assembly, the end of the first movement member away from the second movement member is connected to the first rod, and the end of the second movement member away from the first movement member is connected to the second rod.

In some implementations, the end of the first movement member away from the second movement member may be rotatable around a circumferential direction of the first rod, and/or the end of the second movement member away from the first movement member may be rotatable around a circumferential direction of the second rod.

In some implementations, the clothing treatment device may include multiple suspenders, an end of the suspender is connected to the tub assembly, another end of the suspender is connected to the housing, so that the tub assembly is suspended from the housing by multiple suspenders, the second rod is a part of the suspender, or the second rod is connected to the suspender.

In some implementations, the clothing treatment device may include an operation platform arranged at a top end of the housing, an end of the second rod is connected to the operation platform, and another end of the second rod extends downward from the operation platform.

In some implementations, the clothing treatment device may include a mounting seat arranged at an inner side of the housing, and at least one end of the second rod is arranged on the mounting seat.

In some implementations, one of the first movement member and the second movement member may have a degree of freedom (DOF) of moving in an up-down direction.

In some implementations, one of the first movement member and the second movement member may have a DOF of swinging up and down.

In some implementations, the damping assembly may include a friction member arranged at the rotation joint of the first movement member and the second movement member, to provide friction force to achieve damping when the first movement member and the second movement member rotate relatively.

In some implementations, the first movement member may include a first connection seat, the second movement member may include a second connection seat.

The first connection seat includes a first annular portion, the second connection seat includes a second annular portion, the first annular portion and the second annular portion are nested with each other and provided with an annular space in a radial direction, and the friction member is arranged in the annular space.

In some implementations, the first connection seat may include a first end plate connected to the first annular portion, the second connection seat may include a second end plate connected to the second annular portion, the first end plate and the second end plate are arranged in parallel, and the first annular portion and the second annular portion are located between the first end plate and the second end plate.

In some implementations, the second annular portion may surround an outer circumference of the first annular portion, the second end plate is provided with a through hole, the first connection seat further includes one or more elastic hooks arranged into an inner space of the first annular portion, an end of the elastic hook is connected to the first end plate, and another end of the elastic hook passes through the through hole and is connected to a surface at a side of the second end plate away from the first end plate.

Alternatively, the first annular portion may surround an outer circumference of the second annular portion, the first end plate is provided with a through hole, the second connection seat further includes one or more elastic hooks arranged into an inner space of the second annular portion, an end of the elastic hook is connected to the second end plate, and another end of the elastic hook passes through the through hole and is connected to a surface at a side of the first end plate away from the second end plate.

In some implementations, the first connection seat may further include a limit structure arranged on the first end plate and located at an outer circumferential side of the first annular portion, and the limit structure is configured to form stop-fitting with the second movement member in a circumferential direction, to limit a maximum rotation angle when the second movement member rotates relative to the first movement member.

Alternatively, the second connection seat may further include a limit structure arranged on the second end plate and located at an outer circumferential side of the second annular portion, and the limit structure is configured to form stop-fitting with the first movement member in a circumferential direction, to limit a maximum rotation angle when the first movement member rotates relative to the second movement member.

According to the clothing treatment device provided in the embodiments of the disclosure, when the tub assembly vibrates and deflects, the tub assembly transmits vibration energy to the damping assembly, the first movement member and the second movement member rotate relatively, to adapt to vibration displacements of the tub assembly in different vibration directions, the axis around which the first movement member and the second movement member rotate relatively is substantially parallel to the height direction, and damping force generated by the damping assembly is mainly in a horizontal direction, so that vibration energy of the tub assembly in the horizontal direction may be absorbed effectively, thereby reducing horizontal vibration displacement of the tub assembly, and reducing a probability of the tub assembly hitting the housing, so that the damping assembly has satisfactory horizontal damping effect. Furthermore, relative rotation of the first movement member and the second movement member may also reduce a probability of sticking movement of the damping assembly, and improve movement reliability of the damping assembly.

Figure 1:
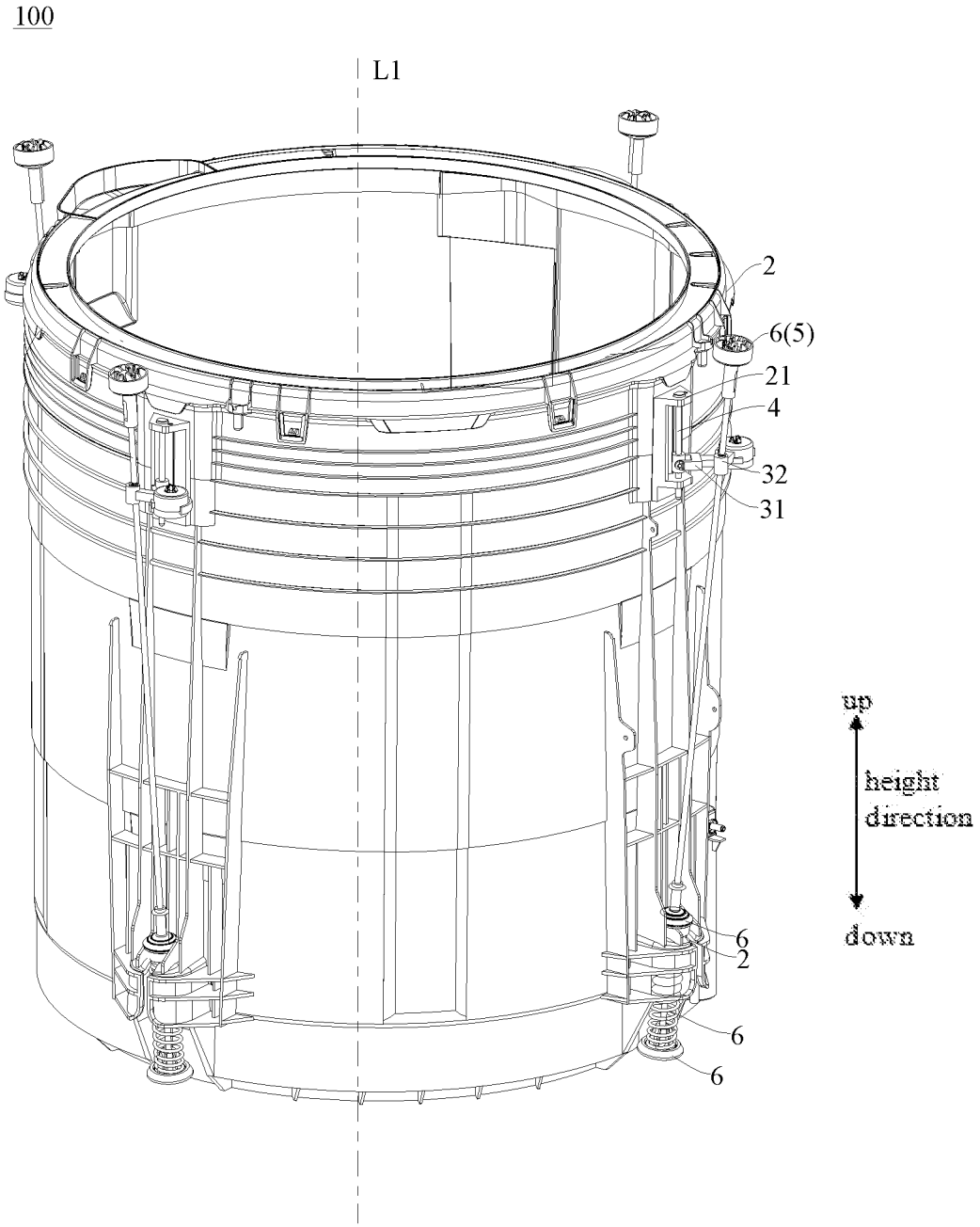
FIG. 1 is a schematic structural diagram of a clothing treatment device according to an embodiment of the disclosure.
Figure 2:
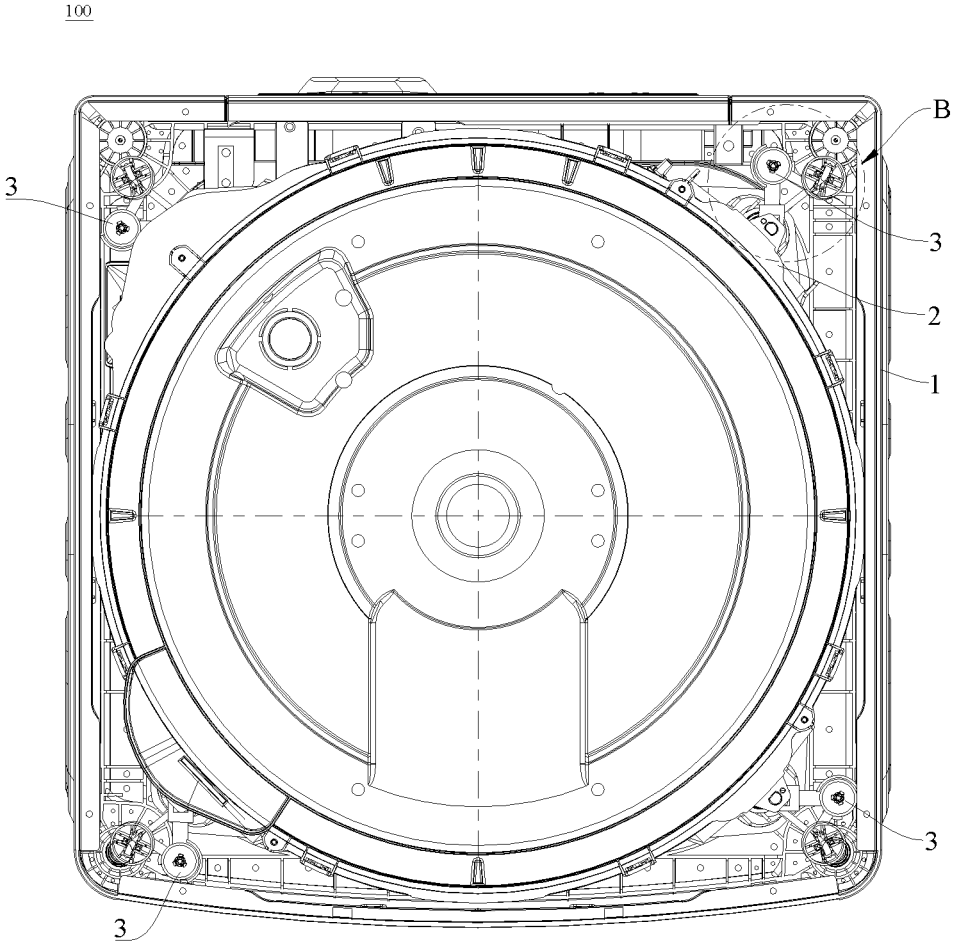
FIG. 2 is a schematic structural diagram of the structure shown in FIG. 1 from another perspective.
Figure 3:
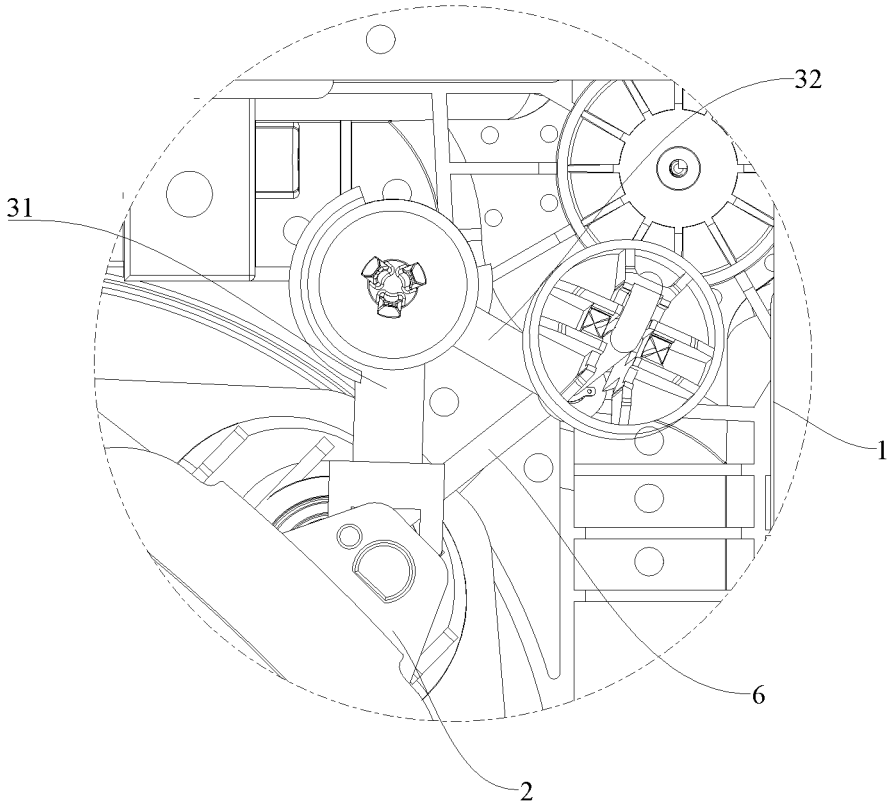
FIG. 3 is a schematic enlarged view at B of FIG. 2.

Description of reference numerals is provided as follows:

100—clothing treatment device;

1—housing; 11—mounting seat;

2—tub assembly; 21—mounting block; 2*a*—connection slot;

3—damping assembly; 31—first movement member; 311—first connection seat; 3111—first annular portion; 3112—first end plate; 3113—elastic hook; 3114—limit structure; 312—first connection structure; 313—first connection portion; 32—second movement member; 32*a*—first hole; 321—second connection seat; 3211—second annular portion; 3212—second end plate; 3212*a*—through hole; 322—connector; 322*a*—penetration hole; 323—seat sleeve; 323*a*—accommodation cavity; 33—friction member; 3*a*—first position; 3*b*—second position;

4—first rod;

5—second rod;

6—suspender; 62—damping spring; 63—damping cylinder; 64—base;

7—operation platform.

DETAILED DESCRIPTION

In order to make the object, technical solutions and advantages of the disclosure more apparent, the disclosure will be further described in detail below with reference to the drawings and embodiments. It should be understood that specific embodiments described here are only intended to explain the disclosure and are not intended to limit the disclosure.

Various specific technical features described in the specific embodiments may be combined in any suitable manner without conflict, for example, different embodiments and technical solutions may be formed by combinations of different specific technical features. In order to avoid unnecessary repetition, various possible combinations of various specific technical features in the disclosure are not described any more.

Terms "first\second\ . . . " involved in the following descriptions are only intended to distinguish different objects, and do not mean that there are similarities or relationships between objects. It should be understood that descriptions related to orientations "above", "below", "outside" and "inside" are all orientations in a normal usage state, and directions "left" and "right" indicate left and right directions shown in a specific corresponding schematic diagram, which may be or may not be left and right directions in a normal usage state.

It should be noted that terms "include", "including" or any other variant thereof are intended to encompass non-exclusive inclusion, so that a process, method, article or device including a series of elements includes not only those elements, but also other elements which are not listed clearly, or elements inherent to such process, method, article or device. In absence of any further limitation, an element defined by a phrase "include a . . . " does not preclude existence of another identical element in a process, method, article or device including this element. "multiple" means equal to or greater than two.

Embodiments of the disclosure provide a clothing treatment device 100, with reference to FIG. 1 to FIG. 19, the clothing treatment device 100 includes a housing 1, a tub assembly 2, and a damping assembly 3.

It may be understood that specific form of the clothing treatment device 100 is not limited, and may be an existing pulsator washing machine, a drum washing machine or the like, which is not limited here; preferably, the damping assembly 3 described in the embodiments of the disclosure has better usage effect on the pulsator washing machine.

The tub assembly 2 is arranged in the housing 1.

It may be understood that the tub assembly 2 may include a drum and a tub, the drum is arranged inside the tub, and a space within the drum defines a clothing treatment chamber. The drum may be a perforated drum or a non-perforated drum. When the drum is a perforated drum, water is held by the tub; when the drum is a non-perforated drum, water is held by the drum itself, that is, both water and clothes may be held in the drum, and water in the drum may not enter the tub during washing. In some embodiments, the tub assembly 2 may be provided with only the drum and is not provided with the tub, and at this time, the drum is a non-perforated drum.

The housing 1 may provide an accommodation space and protection for the tub assembly 2, isolate the tub assembly 2 from the external environment, and reduce a probability of impurities such as dust from the external environment or the like contacting the tub assembly 2. When the clothing treatment device 100 is impacted, the housing 1 may also effectively resist impact from the external environment and reduce a probability of damage of the tub assembly 2.

It may be understood that when the tub assembly 2 includes the drum and the tub, an end of the damping assembly 3 may be connected to the tub, and when the clothing treatment device 100 includes a suspender 6, an end of the suspender 6 is connected to the tub, and another end of the suspender 6 is connected to the housing 1, to bear weight of the tub assembly 2; when the tub assembly 2 is provided with only the drum, the tub assembly 2 may include a water receiving tray arranged out of the drum, an end of the damping assembly 3 may be connected to the water receiving tray, and when the clothing treatment device 100 includes a suspender 6, an end of the suspender 6 is connected to the water receiving tray, and another end of the suspender 6 is connected to the housing 1, to bear weight of the tub assembly 2.

In this embodiment, descriptions are made by an example of the tub assembly 2 including the drum and the tub.

It may be understood that when the clothing treatment device is in an operation condition of washing or spin-drying, the drum rotates, and clothes in the drum may shift during rotation of the drum, so that the center of gravity of the drum may shift, and thus the drum rotates eccentrically, resulting in vibration and deflection of the tub. When eccentricity of rotation of the drum increases, amplitude of the tub may also increase correspondingly, which makes the tub assembly easily hit the housing and affect the spin-drying process.

The damping assembly 3 is a structure with a damping function. The damping assembly 3 provided in this embodiment is intended to absorb vibration energy of the tub assembly 2 when the clothing treatment device 100 is in the operation condition of washing or spin-drying, to reduce a probability of the tub assembly 2 hitting the housing 1.

Figure 8:
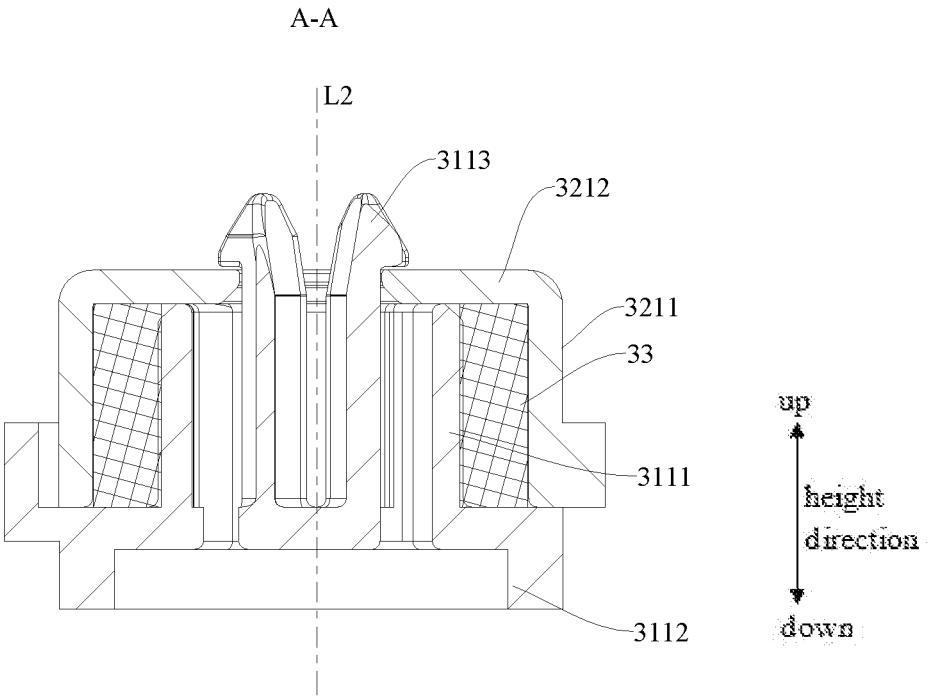
FIG. 8 is a schematic structural diagram of the structure shown in FIG. 5 from yet another perspective.

With reference to FIG. 1 and FIG. 8, the damping assembly 3 includes a first movement member 31 and a second movement member 32 connected to each other, an end of the first movement member 31 away from the second movement member 32 is connected to the tub assembly 2, and an end of the second movement member 32 away from the first movement member 31 is connected to a component out of the tub assembly 2.

The first movement member 31 and the second movement member 32 are relatively rotatable around their joint, and an axis around which the first movement member 31 and the second movement member 32 rotate relatively is substantially parallel to an axis L1 of the tub assembly 2.

It should be noted that when the clothing treatment device 100 is in the operation condition of washing or spin-drying, the tub assembly 2 vibrates and deflects, and transmits vibration energy to the damping assembly 3, the first movement member 31 and the second movement member 32 of the damping assembly 3 rotate relatively under action of vibration, to adapt to variation of different vibration directions of the tub assembly 2, thereby consuming vibration energy of the tub assembly 2 and suppressing vibration amplitude of the tub assembly 2.

It should be noted that the component out of the tub assembly 2 is a component, independent of the tub assembly 2 and arranged out of the tub assembly 2, of the clothing treatment device 100. For example, the component may be the suspender 6, an operation platform 7, the housing 1 or the like, which is not limited here. Therefore, the tub assembly 2 and the component out of the tub assembly 2 may jointly provide support for the damping assembly 3, to improve mounting reliability of the damping assembly 3.

It should be noted that the first movement member 31 and the second movement member 32 relatively rotatable around their joint, means that at least one of the first movement member 31 or the second movement member 32 may rotate with their joint as a center, so that the first movement member 31 and the second movement member 32 may rotate relatively.

"The axis L2 around which the first movement member 31 and the second movement member 32 rotate relatively is substantially parallel to the axis L1 of the tub assembly 2" means that the axis L2 around which the first movement member 31 and the second movement member 32 rotate relatively is substantially parallel to a height direction. "Substantially parallel to" means that an angle between the axis L2 around which the first movement member 31 and the second movement member 32 rotate relatively and the axis L1 of the tub assembly 2 may be 0° or close to 0°, that is, certain machining and assembly errors are allowed. Exemplarily, the angle between the axis L2 around which the first movement member 31 and the second movement member 32 rotate relatively and the axis L1 of the tub assembly 2 is 0°~5°, such as 0°, 0.3°, 0.5°, 0.7°, 0.9°, 1°, 1.2°, 1.4°, 1.6°, 1.8°, 2°, 3°, 4°, 5°, etc.

A pulsator clothing treatment device is taken as an example, in case that an external size of a housing is unchanged, a washing volume of the pulsator clothing treatment device gradually increases, which makes a horizontal gap between the housing and a tub assembly become smaller and smaller. Furthermore, in the operation condition of washing or spin-drying, the tub assembly may vibrate in a horizontal direction and in a height direction, and mainly vibrates in the horizontal direction, vibration displacement of the tub assembly in the height direction is small and is not easy to hit the tub, while vibration displacement of the tub assembly in the horizontal direction is large and is easy to exceed the horizontal gap between the housing and the tub assembly to hit the housing. Therefore, it is necessary to effectively suppress horizontal vibration of the tub assembly.

In the related art, in order to reduce vibration of the tub assembly in the horizontal direction, the clothing treatment device is provided with a damper, the damper includes a first movement member and a second movement member connected to each other, an end of the first movement member is connected to the tub assembly, an end of the second movement member is connected to a suspender, and when the tub assembly vibrates, the damper moves with the tub assembly to dissipate vibration energy of the tub assembly. However, rotation axes of the first movement member and the second movement member of the damper are substantially parallel to the horizontal direction, that is, the first movement member and the second movement member substantially swing in a vertical plane, and damping force against vibration is mainly decomposed into force along the height direction, and component force along the horizontal direction is small, so that horizontal vibration of the tub assembly cannot be effectively absorbed, and damping effect is limited.

It may be understood that the horizontal direction refers to a direction parallel to a horizontal plane after the clothing treatment device 100 is placed on the horizontal ground, such as a left-right direction, a front-back direction, and other horizontal directions intersecting the left-right direction and the front-back direction.

In this embodiment, when the tub assembly 2 vibrates and deflects, the first movement member 31 and the second movement member 32 of the damping assembly 3 may relatively rotate around their joint, and vibration of the tub assembly 2 forces the damping assembly 3 to absorb energy. Since the axis L2 around which the first movement member 31 and the second movement member 32 rotate relatively is substantially parallel to the height direction, that is, the first movement member 31 and the second movement member 32 relatively rotate in the horizontal direction substantially, damping force generated by the damping assembly 3 is mainly in the horizontal direction, thereby effectively suppressing vibration of the tub assembly 2 in the horizontal direction.

It should be noted that the first movement member 31 and the second movement member 32 may be made of materials with friction damping characteristics. When the first movement member 31 and the second movement member 32 rotate relatively, the first movement member 31 and the second movement member 32 rub against each other to generate friction damping, so that buffering vibration of the tub assembly 2 is achieved. A structure with friction damping characteristics may also be arranged between the first movement member 31 and the second movement member 32, to generate friction damping when the first movement member 31 and the second movement member 32 rotate relatively, to reduce vibration energy of the tub assembly 2 and reduce horizontal vibration amplitude of the tub assembly 2.

According to the clothing treatment device 100 provided in the embodiments of the disclosure, when the tub assembly 2 vibrates and deflects, the tub assembly 2 transmits vibration energy to the damping assembly 3, the first movement member 31 and the second movement member 32 rotate relatively, to adapt to vibration displacements of the tub assembly 2 in different vibration directions, the axis L2 around which the first movement member 31 and the second movement member 32 rotate relatively is substantially parallel to the height direction, and damping force generated by the damping assembly 3 is mainly in a horizontal direction, so that vibration energy of the tub assembly 2 in the horizontal direction may be absorbed effectively, thereby reducing horizontal vibration displacement of the tub assembly 2, and reducing a probability of the tub assembly 2 hitting the housing 1, so that the damping assembly 3 has satisfactory horizontal damping effect. Furthermore, relative rotation of the first movement member 31 and the second movement member 32 may also reduce a probability of sticking movement of the damping assembly 3, and improve movement reliability of the damping assembly 3.

Figure 6:
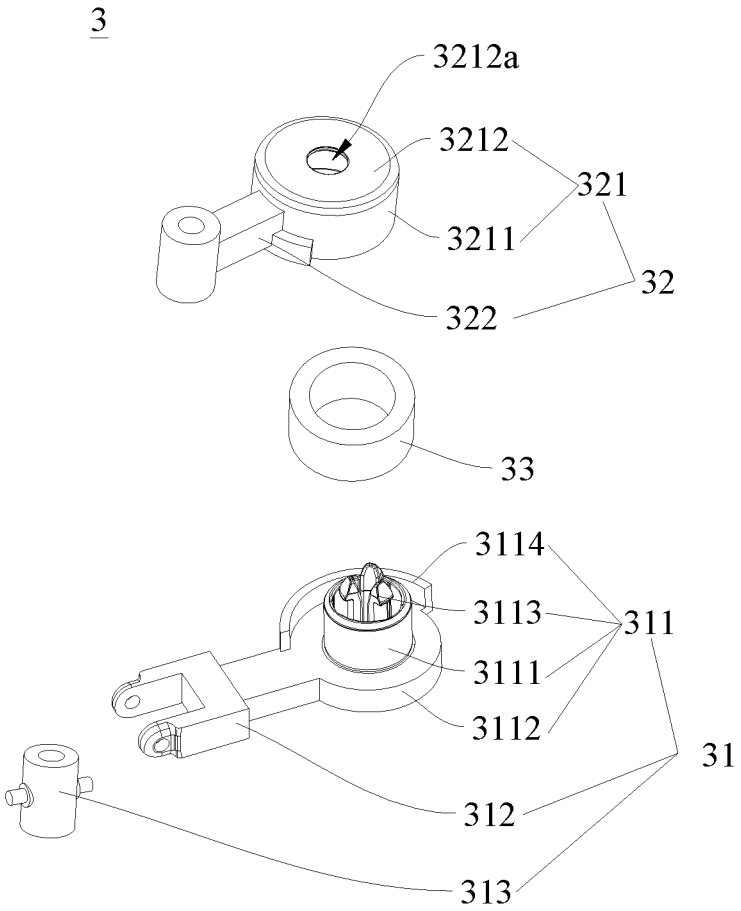
FIG. 6 is a schematic exploded view of the structure shown in FIG. 5.

Exemplarily, in some embodiments, with reference to FIG. 6 and FIG. 8, the damping assembly 3 includes a friction member 33 arranged at the rotation joint of the first movement member 31 and the second movement member 32, to provide friction force to achieve damping when the first movement member 31 and the second movement member 32 rotate relatively.

It should be noted that the friction member 33 refers to a structure of which the material itself has friction damping characteristics.

When the tub assembly 2 vibrates and deflects, the first movement member 31 and the second movement member 32 rotate relatively, rub against the friction member 33 to generate friction damping, and the friction damping may be used as damping force for the damping assembly 3 to reduce vibration of the tub assembly 2. The damping force is substantially in the horizontal direction and may substantially function to reduce horizontal vibration of the tub assembly 2, thereby reducing a probability of the tub assembly 2 hitting the housing 1.

In this embodiment, the friction member 33 is arranged at the rotation joint of the first movement member 31 and the second movement member 32, that is, the friction member 33 does not directly contact the tub assembly 2 or the component out of the tub assembly 2 (such as, the suspender 6), so that abrasion generated by the friction member 33 may be small. Furthermore, when the first movement member 31 and the second movement member 32 rotate relatively, the friction member 33 may also isolate the first movement member 31 from the second movement member 32, to reduce abrasion generated by direct friction when the first movement member 31 and the second movement member 32 rotate, so that service life of the damping assembly 3 may be prolonged.

Material of the friction member 33 is not limited. For example, the friction member 33 may be made of a polyurethane foam material with high abrasion resistance or a soft rubber material with high abrasion resistance, has a high friction coefficient on its surface, and may generate deformation to fit with the first movement member 31 and the second movement member 32. The friction member 33 may also be made of a semi-metallic friction material or the like, which is not limited here.

In some embodiments, a first end of the first movement member 31 is connected to a first end of the second movement member 32, and an angle between a line connecting centers of first and second ends of the first movement member 31 and a line connecting centers of first and second ends of the second movement member 32 does not exceed 180°.

It may be understood that a second end of the first movement member 31 is the end of the first movement member 31 away from the second movement member 32, and the second end of the first movement member 31 is connected to the tub assembly 2; a second end of the second movement member 32 is the end of the second movement member 32 away from the first movement member 31, and the second end of the second movement member 32 is connected to the component out of the tub assembly 2.

It may be understood that "the angle does not exceed 180°" means that before or during the first movement member 31 and the second movement member 32 rotate relatively, one of the first movement member 31 and the second movement member 32 is taken as a reference, then an angle between the line connecting centers of first and second ends of the first movement member 31 and the line connecting centers of first and second ends of the second movement member 32 in the same direction does not exceed 180°. For example, with reference to FIG. 7, the first movement member 31 is taken as a reference, then an angle between the line connecting centers of first and second ends of the first movement member 31 and the line connecting centers of first and second ends of the second movement member 32 in a counter-clockwise direction shown in the figure does not exceed 180° at all times.

It may be understood that when the tub assembly vibrates and deflects, the first movement member and the second movement member rotate relatively under action of vibration, and the relative position of the first movement member and the second movement member changes. When the angle between the line connecting centers of first and second ends of the first movement member and the line connecting centers of first and second ends of the second movement member exceeds 180°, resistance of the first movement member and the second movement member returning to the initial state is increased greatly, so that the first movement member and the second movement member cannot adaptively move according to variation of the vibration position of the tub assembly, resulting in that vibration of the tub assembly cannot be suppressed effectively, and reducing damping reliability of the damping assembly. The initial state is a state where the first movement member and the second movement member are placed when the tub assembly does not vibrate and deflect.

In this embodiment, relative position variation of the first movement member 31 and the second movement member 32 may be limited to a reasonable range, to facilitate the first movement member 31 and the second movement member 32 to adaptively move with variation of the vibration position of the tub assembly 2, reduce a probability of sticking movements of the first movement member 31 and the second movement member 32, and improve damping reliability of the damping assembly 3.

Figure 7:
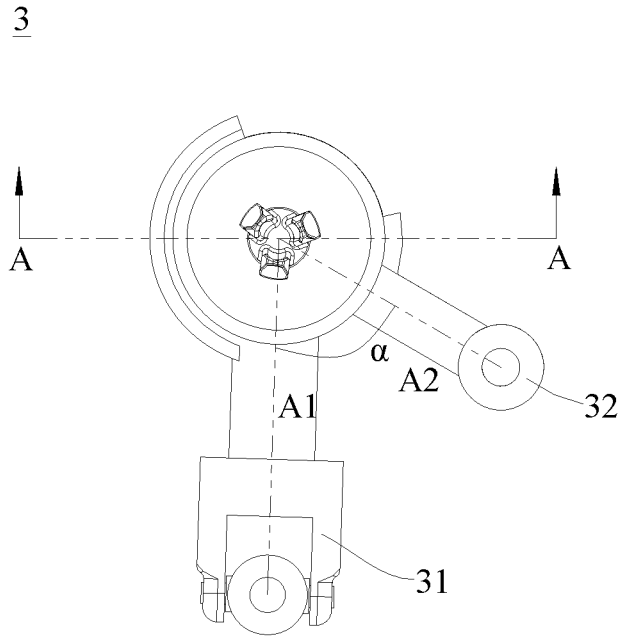
FIG. 7 is a schematic structural diagram of the structure shown in FIG. 5 from another perspective.

In some embodiments, with reference to FIG. 7, when the tub assembly 2 is in a stationary state, an angle $\alpha$ between a line A1 connecting centers of first and second ends of the first movement member 31 and a line A2 connecting centers of first and second ends of the second movement member 32 is not less than 50° and does not exceed 120°, that is, $50° \leq \alpha \leq 120°$, such as 50°, 55°, 60°, 63°, 69°, 72°, 75°, 86°, 90°, 95°, 100°, 110°, 120°, etc.

In this embodiment, when the tub assembly 2 is in a stationary state, the range of the angle $\alpha$ is reasonable, which on one hand, facilitates the first movement member 31 and the second movement member 32 to rotate relatively under vibration of the tub assembly 2, and on the other hand, enables the first movement member 31 and the second movement member 32 to have enough relative rotation range, improving damping reliability of the damping assembly 3.

In some embodiments, a position where the first movement member 31 is connected to the tub assembly 2 is a first position 3*a*, a position where the second movement member 32 is connected to the component out of the tub assembly 2 is a second position 3*b*, and in a planar projection perpendicular to a height direction of the clothing treatment device 100, when the tub assembly 2 is in a stationary state, a line L3 connecting centers of projections of the first position 3*a* and the second position 3*b* is substantially perpendicular to a tangent line L4 of the tub assembly 2 at the first position 3*a*.

"Substantially perpendicular to" means that an angle between the line L3 connecting centers of projections of the first position 3*a* and the second position 3*b* and the tangent line L4 of the tub assembly 2 at the first position 3*a* may be 90° or close to 90°, that is, certain machining and assembly errors are allowed. Exemplarily, the angle $\beta$ between the line L3 connecting centers of projections of the first position 3*a* and the second position 3*b* and the tangent line L4 of the tub assembly 2 at the first position 3*a* is 85°~95°, that is, $85° \leq \beta \leq 95°$, such as 85°, 86°, 87°, 88°, 89°, 90°, 91°, 92°, 93°, 94°, 95°, etc.

In this embodiment, the range of the angle $\beta$ enables the first movement member 31 and the second movement member 32 to be in a relatively stable state when the tub assembly 2 is in a stationary state, and resistance of the first movement member 31 and the second movement member 32 relatively rotating with vibration of the tub assembly 2 may be small when the tub assembly 2 vibrates and deflects, which facilitates improving operation reliability of the damping assembly 3.

Figure 4:
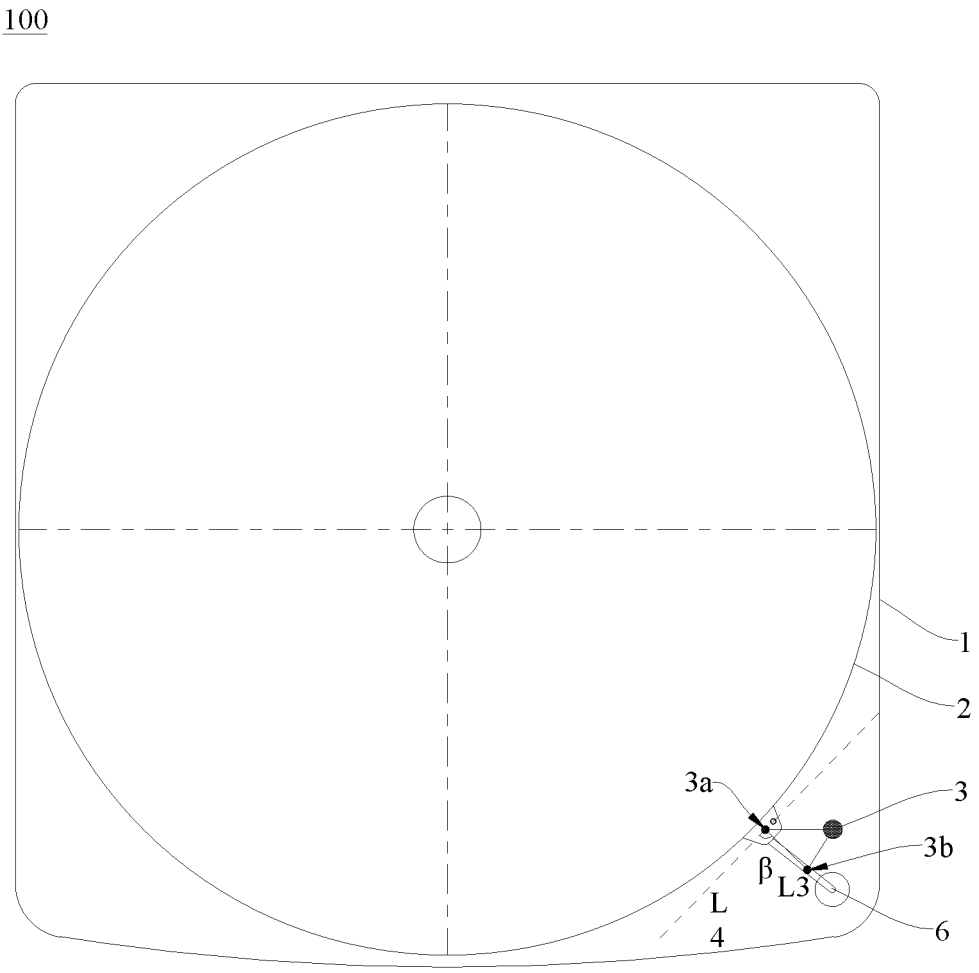
FIG. 4 is a schematic structural diagram of the structure shown in FIG. 1 from yet another perspective.
Figure 5:
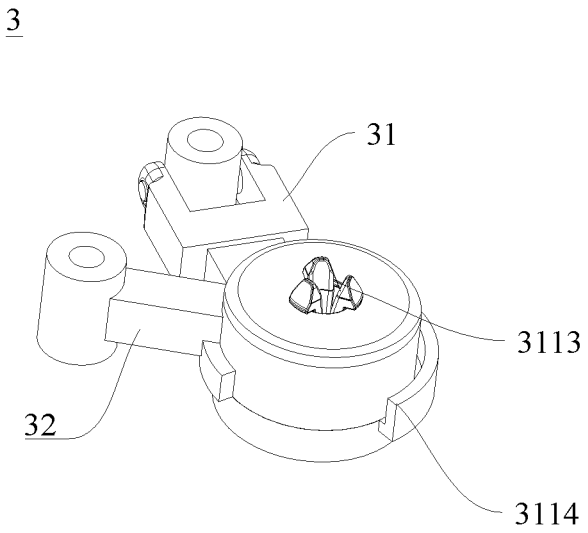
FIG. 5 is a schematic structural diagram of a damping assembly shown in FIG. 1.

FIG. 4 is taken as an example, the first position 3*a* is a position where the first movement member 31 is connected to a first rod 4, and the second position 3*b* is a position where the second movement member 32 is connected to the suspender 6.

In some embodiments, the clothing treatment device 100 includes a first rod 4 and a second rod 5, the first rod 4 is fixed to an outer circumferential side of the tub assembly 2, the end of the first movement member 31 away from the second movement member 32 is connected to the first rod 4, and the end of the second movement member 32 away from the first movement member 31 is connected to the second rod 5.

That is, it may be understood that the second rod 5 is the component out of the tub assembly 2. In this embodiment, the first movement member 31 is connected to the first rod 4, and the second movement member 32 is connected to the second rod 5. Connections with rod-shaped components facilitate the damping assembly 3 to move with vibration of the tub assembly 2, improving convenience of movement.

In some embodiments, the end of the first movement member 31 away from the second movement member 32 is rotatable around a circumferential direction of the first rod 4, and/or the end of the second movement member 32 away from the first movement member 31 is rotatable around a circumferential direction of the second rod 5.

The above contents include multiple situations.

First situation: the end of the first movement member 31 away from the second movement member 32 is rotatable around the circumferential direction of the first rod 4, and the end of the second movement member 32 away from the first movement member 31 fits with the circumferential direction of the second rod 5 in a manner of stopping rotation. When the tub assembly 2 vibrates and deflects, when the first rod 4 transmits vibration energy of the tub assembly 2 to the first movement member 31, the first movement member 31 adapts to variation of the vibration position of the tub assembly 2 by rotating around the circumferential direction of the first rod 4, and at this time, the second movement member 32 may adapt to variation of the vibration position of the tub assembly 2 by sliding relative to the second rod 5 or performing other movement modes. In this embodiment, the damping assembly 3 has at least a degree of freedom (DOF) of rotating around the circumferential direction of the first rod 4 and a DOF of the first movement member 31 and the second movement member 32 rotating relatively.

Second situation: the end of the first movement member 31 away from the second movement member 32 fits with the circumferential direction of the first rod 4 in a manner of stopping rotation, and the end of the second movement member 32 away from the first movement member 31 is rotatable around the circumferential direction of the second rod 5. When the tub assembly 2 vibrates and deflects, the second movement member 32 may adapt to variation of the vibration position of the tub assembly 2 by rotating around the circumferential direction of the second rod 5, and at this time, the first movement member 31 may adapt to variation of the vibration position of the tub assembly 2 by sliding relative to the first rod 4 or performing other movement modes. In this embodiment, the damping assembly 3 has at least a DOF of rotating around the circumferential direction of the second rod 5 and a DOF of the first movement member 31 and the second movement member 32 rotating relatively.

Third situation: the end of the first movement member 31 away from the second movement member 32 is rotatable around the circumferential direction of the first rod 4, and the end of the second movement member 32 away from the first movement member 31 is rotatable around the circumferential direction of the second rod 5. When the tub assembly 2 vibrates and deflects, the first movement member 31 rotates around the circumferential direction of the first rod 4, and the second movement member 32 rotates around the circumferential direction of the second rod 5, to adapt to variation of the vibration position of the tub assembly 2. In this embodiment, the damping assembly 3 has at least a DOF of rotating around the circumferential direction of the first rod 4, a DOF of rotating around the circumferential direction of the second rod 5, and a DOF of the first movement member 31 and the second movement member 32 rotating relatively.

Manners of mounting the first rod 4 on the tub assembly 2 are not limited.

In some embodiments, with reference to FIG. 1, the tub assembly 2 includes at least two mounting blocks 21 projecting from an outer circumferential wall of the tub assembly 2, the two mounting blocks 21 are arranged at an interval in the height direction, two ends of the first rod 4 are fixed to the mounting blocks 21, and the first movement member 31 is sleeved on a portion of the first rod 4 between the two mounting blocks 21.

In this way, it may improve stability of the first rod 4 fixed to the tub assembly 2 and reduce a probability of the first rod 4 disengaging from the tub assembly 2, and it may also reduce a probability of the first movement member 31 disengaging from the first rod 4.

Specific configuration of the first rod 4 is not limited.

For example, the first rod 4 may be a fixing pin. During installation, the first rod 4 passes through two mounting blocks 21, and a screw is provided at the mounting block 21 located at an upper side, and the screw abuts against a top end of the first rod 4, to reduce a probability of the first rod 4 disengaging from the mounting block 21.

The position where the second rod 5 is arranged, is not limited, as long as the second rod 5 is arranged out of the tub assembly 2.

Figure 9:
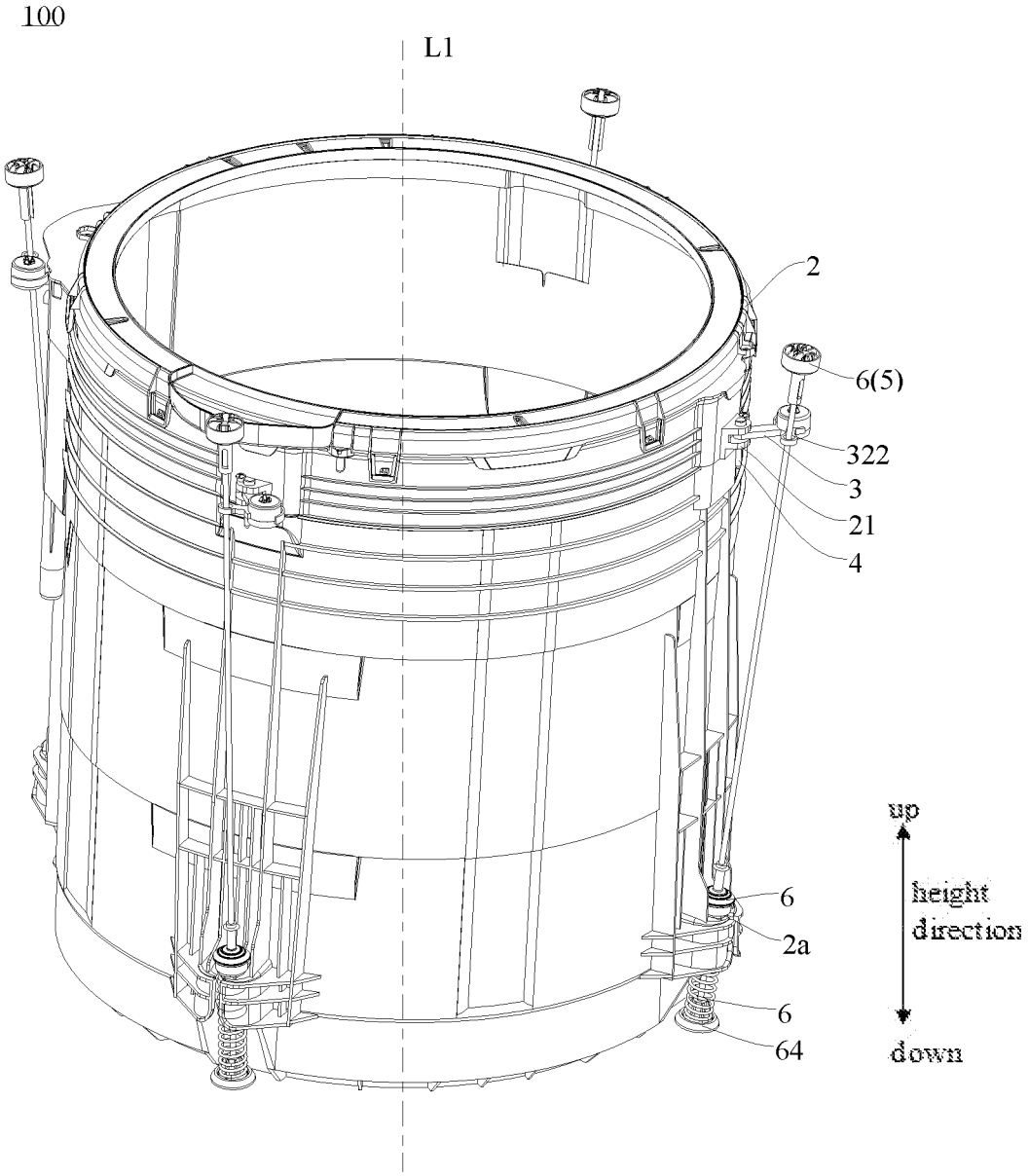
FIG. 9 is a schematic structural diagram of a clothing treatment device according to another embodiment of the disclosure.
Figure 10:
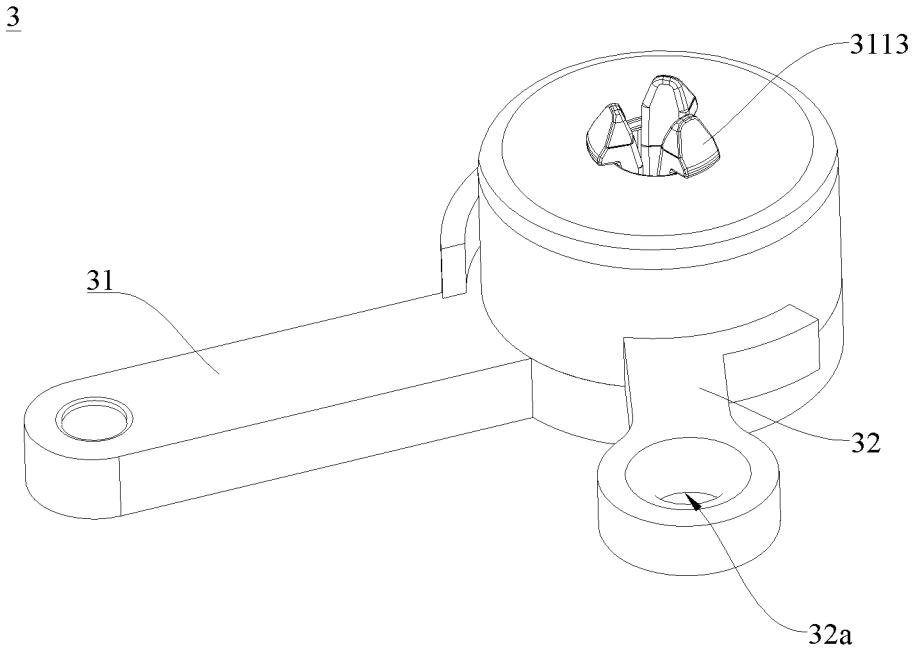
FIG. 10 is a schematic structural diagram of a damping assembly shown in FIG. 9.
Figure 11:
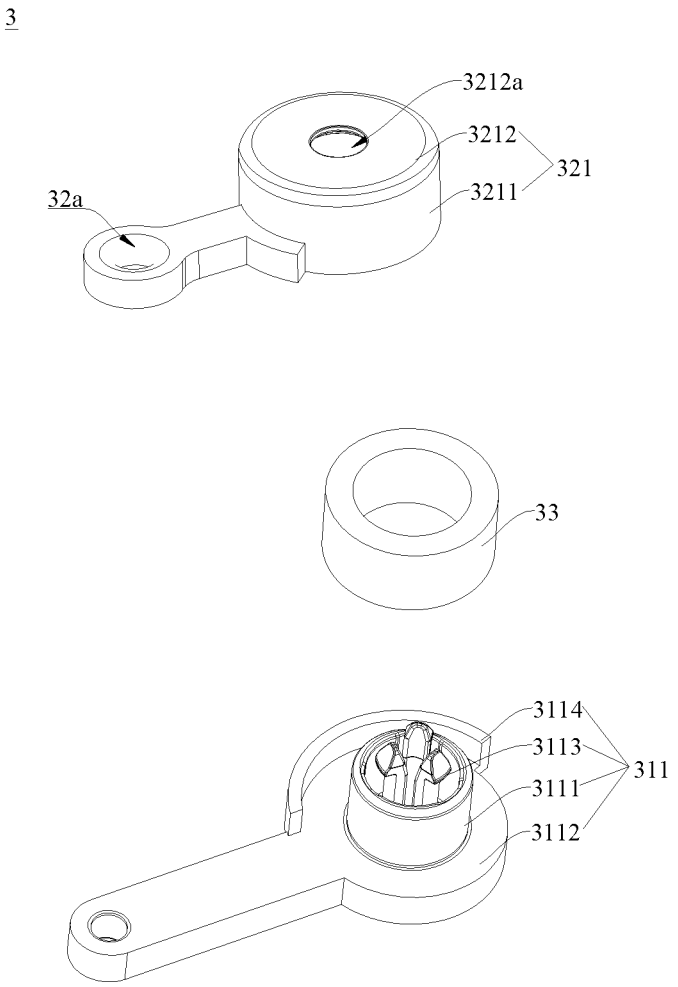
FIG. 11 is a schematic exploded view of the structure shown in FIG. 10.
Figure 12:
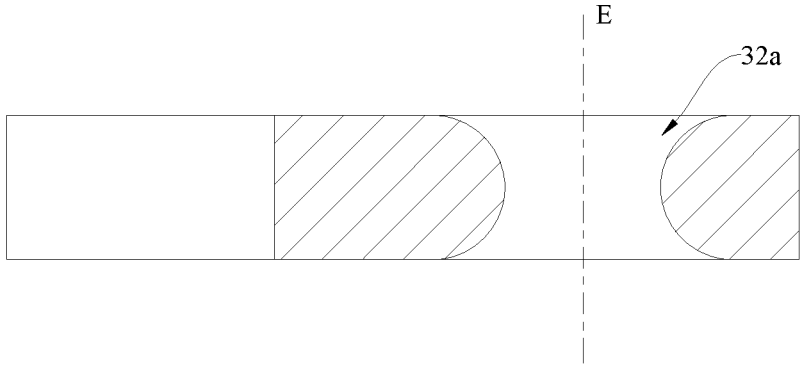
FIG. 12 is a schematic cross-sectional view of a part of structure of a second movement member shown in FIG. 10.
Figure 13:
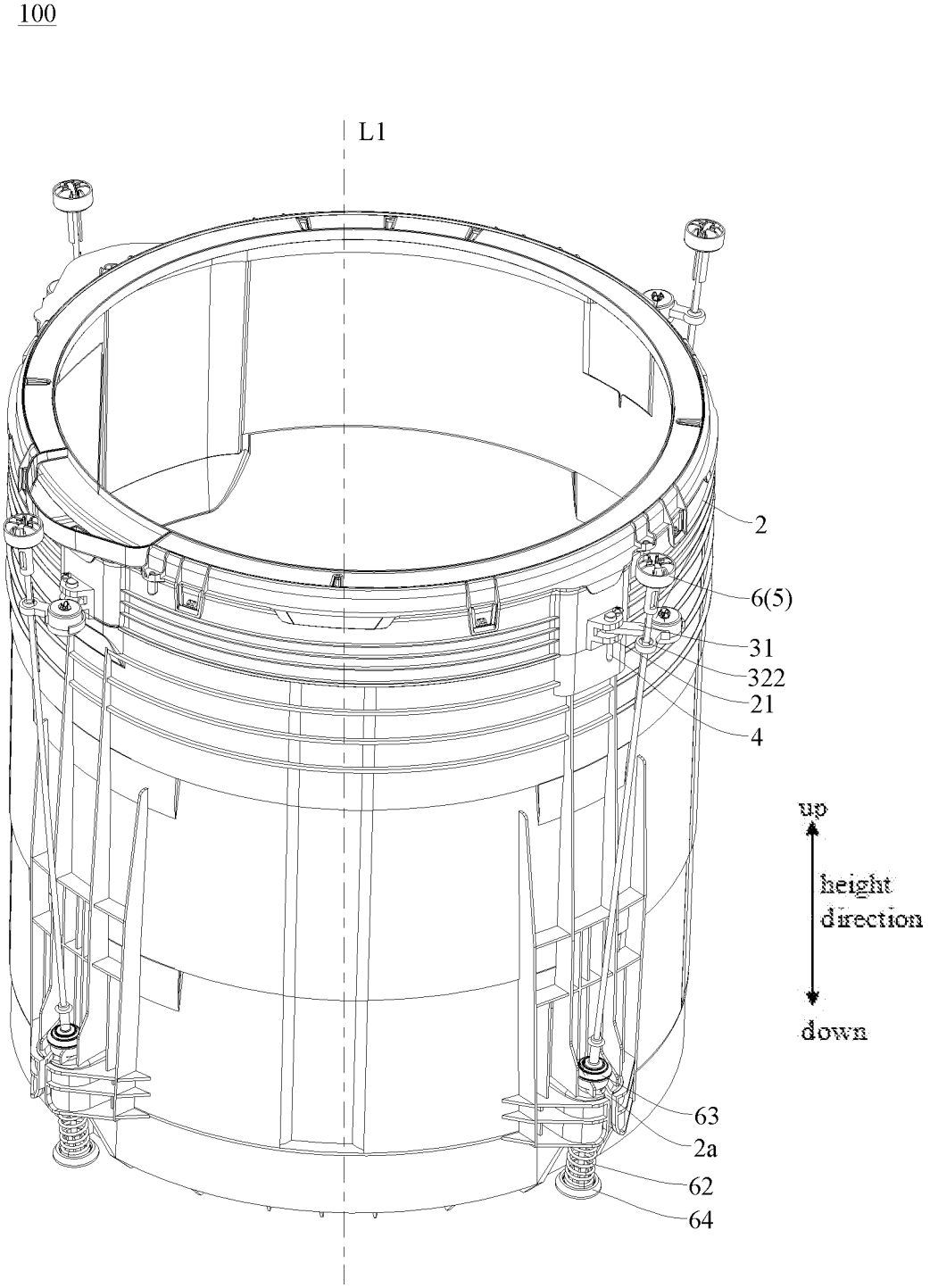
FIG. 13 is a schematic structural diagram of a clothing treatment device according to yet another embodiment of the disclosure.

In some embodiments, with reference to FIG. 1, FIG. 9 and FIG. 13, the clothing treatment device 100 includes multiple suspenders 6, an end of the suspender 6 is connected to the tub assembly 2, another end of the suspender 6 is connected to the housing 1, so that the tub assembly 2 is suspended from the housing 1 by multiple suspenders 6.

Top ends of the suspenders 6 are fixed to the housing 1, bottom ends of the suspenders 6 are fixed to the tub assembly 2, there are four suspenders 6 in number, top ends of the four suspenders 6 correspond to four corners at a top end of the housing 1, and bottom ends of the four suspenders 6 are fixed to side walls of the tub assembly 2 corresponding to the four corners of the housing 1. In this way, each suspender 6 may uniformly share weight of the tub assembly 2 and improve mounting stability of the clothing treatment device 100.

In some examples, with reference to FIG. 1, FIG. 9 and FIG. 13, the second rod 5 is a part of the suspender 6.

In this embodiment, the first movement member 31 is connected to the tub assembly 2 through the first rod 4, the second movement member 32 is connected to the suspender 6, there is enough mounting space between the tub assembly 2 and the suspender 6 to arrange the damping assembly 3, the suspender 6 has enough structural strength to facilitate providing movement support for the damping assembly 3, and an end of the damping assembly 3 connected to the suspender 6 may not disengage from the suspender 6, thereby improving mounting stability of the damping assembly 3. Furthermore, the damping assembly 3 is not directly connected to the housing 1, and vibration energy of the tub assembly 2 is transmitted to the housing 1 through the damping assembly 3 and the suspenders 6, so that vibration energy received by the housing 1 may be reduced, and operation stability of the clothing treatment device 100 may be improved.

In some other embodiments, the second rod 5 may also be connected to the suspender 6. The suspender 6 may provide support for the second rod 5, thereby providing enough support for the second movement member 32.

It may be understood that the suspender 6 may also be provided with a damping structure to buffer vibration of the tub assembly 2. Exemplarily, with reference to FIG. 1, the clothing treatment device 100 includes a damping cylinder 63, a base 64 arranged at a bottom end of the suspender 6, and a damping spring 62 arranged on the suspender 6 and sandwiched between the damping cylinder 63 and the base 64. A connection slot 2*a* is formed on an outer circumferential wall at a bottom end of the tub assembly 2, and the connection slot 2*a* is sleeved on the damping cylinder 63. The damping cylinder 63 is sleeved on the suspender 6, the damping spring 62 is a compression spring, an end of the damping spring 62 abuts against a bottom end of the damping cylinder 63, and another end of the damping spring 62 abuts against the base 64. In this way, when the tub assembly 2 vibrates during washing or spin-drying, the damping spring 62 slides up and down along the suspender 6 to absorb longitudinal vibration energy of the tub assembly 2, thereby reducing vibration noise of the housing 1 and improving operation stability of the clothing treatment device 100.

The number of damping assemblies 3 is not limited. Exemplarily, with reference to FIG. 2, there are four damping assemblies 3 in number, there are four first rods 4 in number, an end of each of the four damping assemblies 3 is connected to a respective one of the first rods 4, and another end of each of the four damping assemblies 3 is connected to a respective one of the suspenders 6, so that the damping assemblies 3 may uniformly and sufficiently buffer vibration of the tub assembly 2 from different directions, increase damping effect, and improve operation safety of the clothing treatment device 100.

Figure 16:
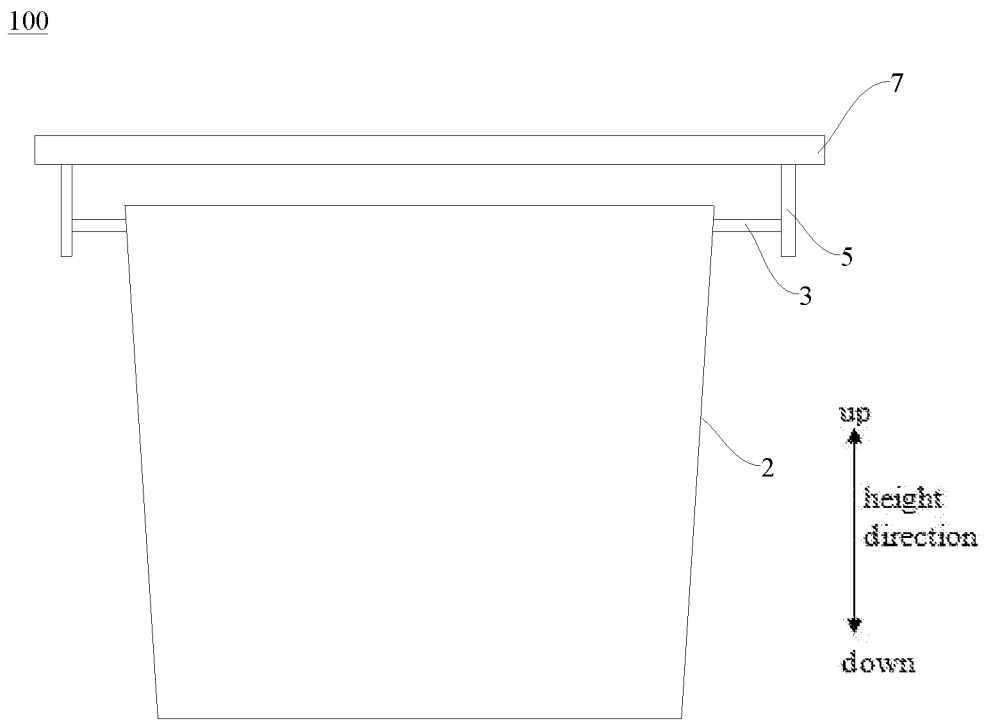
FIG. 16 is a schematic structural diagram of a clothing treatment device according to yet another embodiment of the disclosure.

In some embodiments, with reference to FIG. 16, the clothing treatment device 100 includes an operation platform 7 arranged at a top end of the housing 1, an end of the second rod 5 is connected to the operation platform 7, another end of the second rod 5 extends downward from the operation platform 7 to form a suspended free end, or extends downward and then is connected to a lower part or a bottom plate of the housing 1, and the second movement member 32 is connected to the operation platform 7 through the second rod 5.

It may be understood that the operation platform 7 is located at a top side of the housing 1, and the operation platform 7 is provided with a clothing access port communicated with the clothing treatment chamber, that is, to-be-cleaned clothes may be put into the clothing treatment chamber from the top side through the clothing access port, and cleaned clothes may also be taken out from the clothing treatment chamber through the clothing access port.

In this embodiment, the first movement member 31 is connected to the tub assembly 2 through the first rod 4, the second movement member 32 is connected to the operation platform 7 through the second rod 5, and the tub assembly 2 and the operation platform 7 jointly provide mounting support for the damping assembly 3, to improve mounting stability and movement stability of the damping assembly 3. Furthermore, the damping assembly 3 is not directly connected to the housing 1, vibration energy of the tub assembly 2 is transmitted to the housing 1 through the damping assembly 3 and the operation platform 7, and the operation platform 7 may share a part of the vibration energy for the housing 1, which may reduce vibration noise of the housing 1 and improve operation stability of the clothing treatment device 100.

Furthermore, the second rod 5 extends downward from the operation platform 7, and an axis of the second rod 5 is in the height direction. In an embodiment where the second movement member 32 rotates around the circumferential direction of the second rod 5, it facilitates the second movement member 32 to rotate around the circumferential direction of the second rod 5, to reduce rotation resistance.

Figure 17:
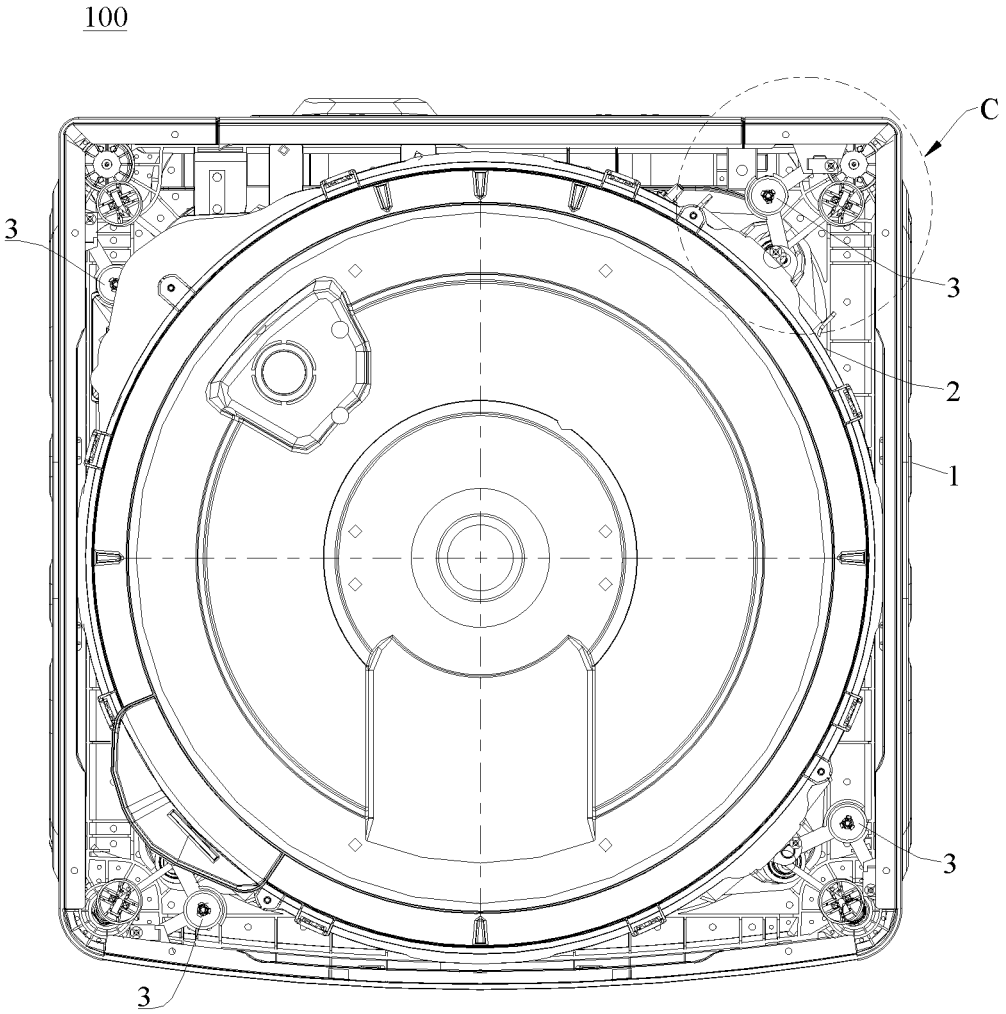
FIG. 17 is a schematic structural diagram of a clothing treatment device according to yet another embodiment of the disclosure.
Figure 18:
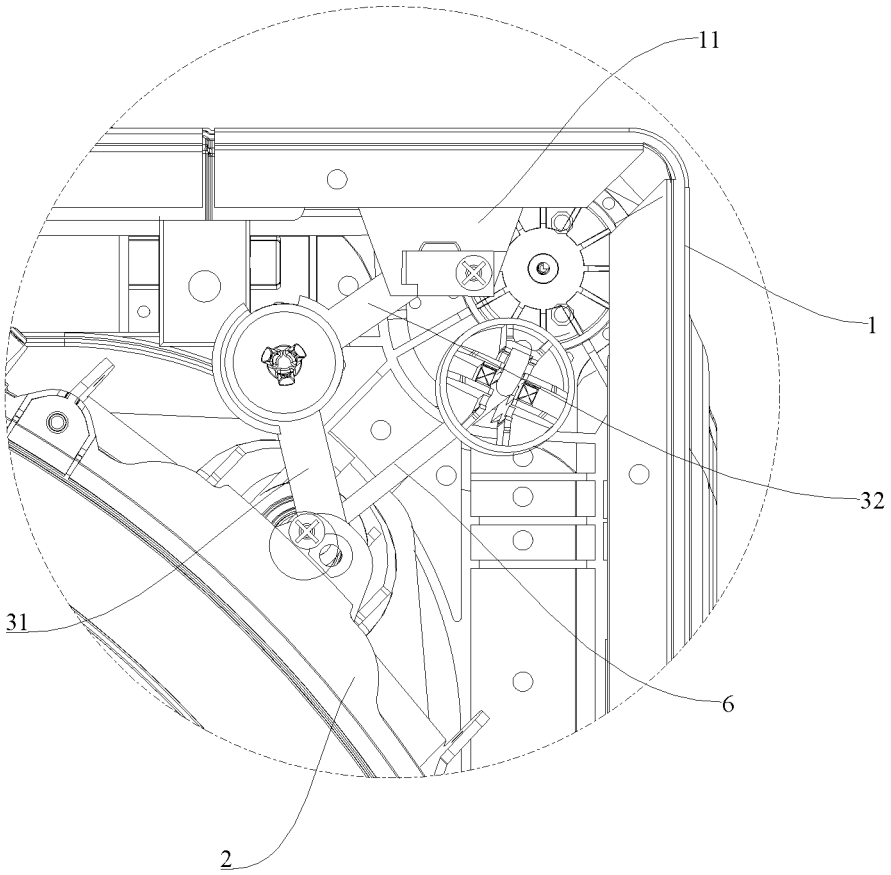
FIG. 18 is a schematic enlarged view at C of FIG. 17.
Figure 19:
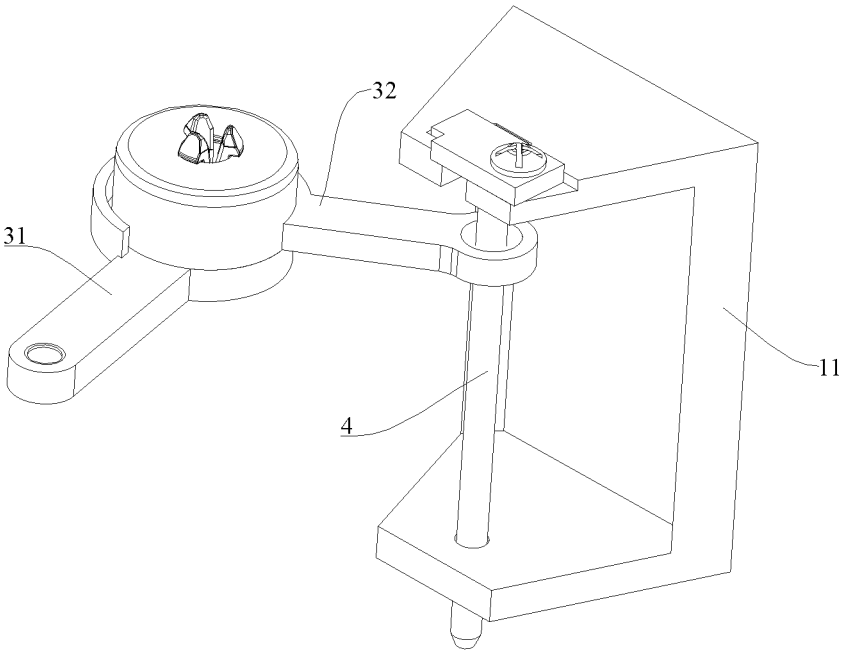
FIG. 19 is a schematic structural diagram of fitting of a damping assembly and a mounting seat shown in FIG. 17.

In some embodiments, with reference to FIG. 17 to FIG. 19, the clothing treatment device 100 includes a mounting seat 11 arranged at an inner side of the housing 1, at least one end of the second rod 5 is arranged on the mounting seat 11, and the second movement member 32 connected to the housing 1 through the second rod 5.

In this embodiment, the first movement member 31 is connected to the tub assembly 2 through the first rod 4, and the second movement member 32 is connected to the housing 1 through the second rod 5, to connect the damping assembly 3 to the tub assembly 2 and the housing 1 respectively, and the tub assembly 2 and the housing 1 jointly provide support for the damping assembly 3. In this way, the damping assembly 3 has enough mounting space and movement space, to facilitate buffering vibration of the tub assembly 2.

In some embodiments, one of the first movement member 31 and the second movement member 32 has a DOF of moving in an up-down direction.

That is, an end of the first movement member 31 sleeved on the first rod 4 may slide up and down along the first rod 4, or an end of the second movement member 32 sleeved on the second rod 5 may slide along an extension direction of the second rod 5.

In this embodiment, when the tub assembly 2 vibrates and deflects, the first movement member 31 and the second movement member 32 rotate relatively, while the first movement member 31 may move up and down relative to the first rod 4, or the second movement member 32 may move up and down relative to the second rod 5, to further adapt to variation of the vibration position of the tub assembly 2 and reduce a probability of sticking the damping assembly 3.

In an embodiment where the first movement member 31 may rotate around the circumferential direction of the first rod 4 and the second movement member 31 may rotate around the circumferential direction of the second rod 5, the damping assembly 3 has at least four movement DOFs, further reducing a probability of sticking its movement.

In some embodiments, one of the first movement member 31 and the second movement member 32 has a DOF of swinging up and down.

That is, the first movement member 31 may swing up and down relative to the first rod 4, or the second movement member 32 may swing up and down relative to the second rod 5.

In this embodiment, when the tub assembly 2 vibrates and deflects, the first movement member 31 and the second movement member 32 rotate relatively, while the first movement member 31 may swing up and down relative to the first rod 4, or the second movement member 32 may swing up and down relative to the second rod 5, to further adapt to variation of the vibration position of the tub assembly 2 and reduce a probability of sticking the damping assembly 3.

It may be understood that in an embodiment where the first movement member 31 is rotatable around the circumferential direction of the first rod 4, the second movement member 31 is rotatable around the circumferential direction of the second rod 5, and one of the first movement member 31 and the second movement member 32 has a movement DOF, one of the first movement member 31 and the second movement member 32 has a DOF of swinging up and down, that is, the damping assembly 3 has at least five DOFs, which further reduces a probability of sticking movement of the damping assembly 3.

It may be understood that the first movement member 31 may have a DOF of sliding up and down and a DOF of swinging up and down simultaneously, or the second movement member 32 may have a DOF of sliding up and down and a DOF of swinging up and down simultaneously, or one of the first movement member 31 and the second movement member 32 may have a DOF of sliding up and down, and another one of the first movement member 31 and the second movement member 32 may have a DOF of swinging up and down, which is not limited here.

Manners of achieving up-down movement and up-down swing are not limited.

For example, in some embodiments, with reference to FIG. 1 to FIG. 8, the first movement member 31 includes a first connection seat 311, a first connection structure 312 and a first connection portion 313. The first connection seat 311 is arranged at an end of the first connection structure 312. The first connection portion 313 is arranged at another end of the first connection structure 312, and the first connection portion 313 is sleeved on the first rod 4, and is rotatable around the circumferential direction of the first rod 4 and slides up and down along the first rod 4. The first connection structure 312 is rotationally connected to the first connection portion 313, and an axis around which the first connection structure 312 and the first connection portion 313 rotate, is perpendicular to an axis of the first rod 4, so that the first connection structure 312 may swing up and down relative to the first connection portion 313. In this way, when the tub assembly 2 vibrates and deflects, the first movement member 31 has a DOF of rotating circumferentially, a DOF of moving up and down and a DOF of swinging up and down.

In this embodiment, the whole of the second movement member 32 may be a rigid member and has only one rotation DOF.

It should be noted that the rigid member is a single element forming a mechanism, and is a rigid body with equivalent movement to an adjacent member. The rigid member is a basic unit forming the mechanism in mechanism and having a determined relative movement relationship there-between.

The second movement member 32 may be an integrated member, which has a simple structure and is manufactured and molded easily.

In some other embodiments, with reference to FIG. 9 to FIG. 12, an end of the second movement member 32 away from the first movement member 31 is provided with a first hole 32*a*, the second rod 5 is slidably arranged in the first hole 32*a*, and in directions from opposite ends of the first hole 32*a* along an axial direction thereof to an middle position of the first hole 32*a* along the axial direction thereof, a hole wall of the first hole 32*a* extends toward an axis of the first hole 32*a*. In this way, the second movement member 32 may rotate around the circumferential direction of the second rod 5, slide along the extension direction of the second rod 5, and swing up and down relative to the second rod 5.

That is, aperture of the first hole 32*a* gradually decreases in directions from opposite ends of the first hole 32*a* along the axial direction thereof to the middle position of the first hole 32*a* along the axial direction thereof, the aperture of the first hole 32*a* at the middle position along the axial direction is smaller than apertures of the first hole 32*a* at two ends along the axial direction, and the aperture of the first hole 32*a* is approximately distributed to be large at two ends and small in the middle.

In this embodiment, a gap between the second rod 5 and the hole wall of the first hole 32*a* gradually increases in directions from the middle position of the first hole 32*a* along the axial direction thereof to opposite ends of the first hole 32*a* along the axial direction thereof, so that when the tub assembly 2 vibrates and deflects, when the second movement member 32 slides up and down along the second rod 5 and rotates around the circumferential direction of the second rod 5, the first hole 32*a* may also provide a space for the second movement member 32 to swing up and down. In this way, multiple movement modes are implemented through cooperation of the first hole 32*a* and the second rod 5 only, a probability of sticking movements of the second movement member 32 and the second rod 5 is reduced, and the overall structure of the damping assembly 3 may be simpler.

In this embodiment, the whole of the first movement member 31 may be a rigid member and has only one rotation DOF.

The first movement member 31 may be an integrated member, which has a simple structure and is manufactured and molded easily.

Figure 14:
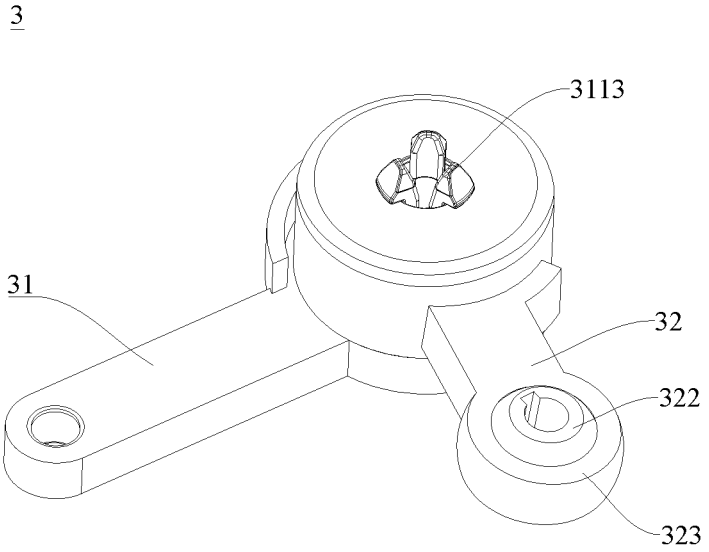
FIG. 14 is a schematic structural diagram of a damping assembly shown in FIG. 13.
Figure 15:
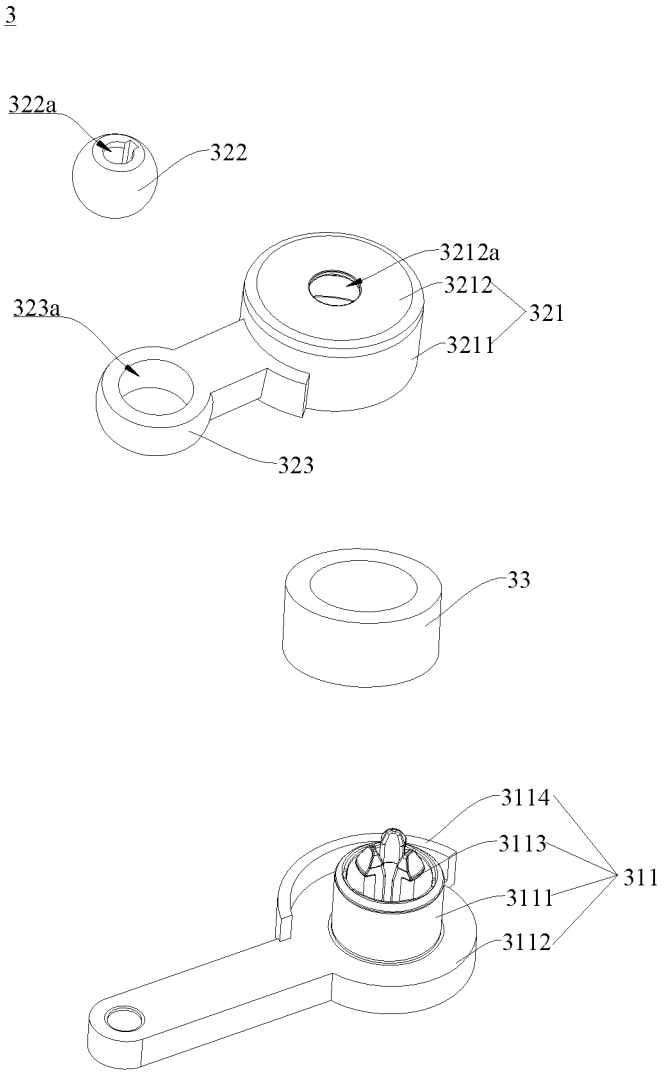
FIG. 15 is a schematic exploded view of the structure shown in FIG. 14.

In some other embodiments, with reference to FIG. 13 to FIG. 15, the second movement member 32 includes a seat sleeve 323 and a connector 322. The connector 322 is provided with a penetration hole 322*a*, the second rod 5 is slidably arranged in the penetration hole 322*a*, the seat sleeve 323 is provided with an accommodation cavity 323*a*, at least a part of the connector 322 is accommodated in the accommodation cavity 323*a*, and surfaces at contact positions of both the connector 322 and the accommodation cavity 323*a* are formed as spherical surfaces, so that the seat sleeve 323 may swing around the connector 322 in omni direction. In this way, the second movement member 32 has a sliding DOF, a DOF of rotating circumferentially and a DOF of swinging up and down.

It should be noted that a part or the whole of the connector 322 may be accommodated in the accommodation cavity 323*a*, and the shape of the connector 322 is not limited. The connector 322 may be a ball-head structure in a spherical shape as a whole, or a combined structure of a spherical structure and other structures, which is not limited here. Exemplarily, with reference to FIG. 15, the connector 322 has a ball-head structure.

The seat sleeve 323 may swing around the connector 322 in omni direction, which means that the seat sleeve 323 may freely rotate around the connector 322 in a random direction within a three-dimensional space.

When the tub assembly 2 vibrates and deflects, the connector 322 drives the seat sleeve 323 to slide along the extension direction of the second rod 5 under action of vibration, and the seat sleeve 323 swings around the connector 322 in omni direction under action of vibration, to adapt to vibration displacements of the tub assembly 2 in different vibration directions, and reduce a probability of sticking movement of the damping assembly 3.

Exemplarily, the connector 322 fits with the second rod 5 in a manner of stopping rotation in a circumferential direction, that is, the connector 322 slides along the extension direction of the second rod 5 only, without rotating around the circumferential direction of the second rod 5. In this way, it facilitates improving movement stability of the second movement member 32.

In this embodiment, the first movement member 31 may be a rigid member and has only one movement DOF.

The first movement member 31 may also include a sliding portion and a universal joint, and up-down movement and universal swing are achieved by cooperation of the sliding portion and the universal joint. The sliding portion is sleeved on an outer circumference of the first rod 4, may slide up and down relative to the first rod 4, and fits with the circumferential direction of the first rod 4 in a manner of stopping rotation. An end of the universal joint is connected to the sliding portion, and may swing around the sliding portion in omni direction, so that the first movement member 31 has a sliding DOF and a DOF of swinging in omni direction.

It may be understood that when the second rod 5 is a part of the suspender 6, the clothing treatment device 100 may further include an adapter sleeved on the suspender 6, and the second movement member 32 is sleeved on the adapter, that is, the second movement member 32 does not directly contact the suspender 6. For example, through cooperation of the second movement member 32 with the adapter, the second movement member 32 may rotate around a circumferential direction of the adapter, thereby achieving rotation around a circumferential direction of the suspender 6, or the second movement member 32 may rotate around the circumferential direction of the suspender 6 under driving of the adapter; the second movement member 32 may also move up and down and/or swing up and down relative to the adapter, to adapt to variation of the vibration position of the tub assembly 2. The adapter may reduce a probability of damage due to the second movement member 32 directly contacting and the suspender 6 when the second movement member 32 moves, prolong service life of the second movement member 32, and improve structural reliability of the damping assembly 3.

It may be understood that the first movement member 31 may slide up and down and swing up and down with reference to the above arrangement of the second movement member 32, and the second movement member 32 may also slide up and down and swing up and down with reference to the above arrangement of the first movement member 31, which is not limited here.

Specific configurations of the first movement member 31 and the second movement member 32 are not limited.

In some embodiments, with reference to FIG. 6 and FIG. 8, the first movement member 31 includes a first connection seat 311, the second movement member 32 includes a second connection seat 321, the first connection seat 311 includes a first annular portion 3111, the second connection seat 321 includes a second annular portion 3211, the first annular portion 3111 and the second annular portion 3211 are nested with each other and provided with an annular space in a radial direction, and the friction member 33 is arranged in the annular space.

It should be noted that each of the first annular portion 3111 and the second annular portion 3211 is an annular structure which is connected end-to-end and is not provided with notches in a circumferential direction. Nested arrangement of the first annular portion 3111 and the second annular portion 3211 means that the first annular portion 3111 is embedded in the second annular portion 3211, or the second annular portion 3211 is embedded in the first annular portion 3111; the annular space is a space between the first annular portion 3111 and the second annular portion 3211, the friction member 33 is arranged in the annular space, that is, the friction member 33 is arranged between the first annular portion 3111 and the second annular portion 3211. When the first movement member 31 and the second movement member 32 rotate relatively, the first annular portion 3111 and the second annular portion 3211 rotate relatively, and thus rub against the friction member 33 to generate friction force.

In this embodiment, the first movement member 31, the second movement member 32 and the friction member 33 are connected together by the nested fitting of the first annular portion 3111 and the second annular portion 3211, so that the overall structure of the damping assembly 3 is simple and mounted easily, and a probability of damage of the friction member 33 during assembly may also be reduced.

In some embodiments, with reference to FIG. 5 to FIG. 8, the first connection seat 311 includes a first end plate 3112 connected to the first annular portion 3111, the second connection seat 321 includes a second end plate 3212 connected to the second annular portion 3211, the first end plate 3112 and the second end plate 3212 are arranged in parallel, and the first annular portion 3111 and the second annular portion 3211 are located between the first end plate 3112 and the second end plate 3212.

It should be noted that the first end plate 3112 and the second end plate 3212 arranged in parallel, refers to a position relationship provided by the first end plate 3112 and the second end plate 3212 after docking of the first movement member 31 and the second movement member 32 is completed.

In this embodiment, the first end plate 3112 and the second end plate 3212 may provide support for the first annular portion 3111 and the second annular portion 3211, and the first annular portion 3111 and the second annular portion 3211 are defined between the first end plate 3112 and the second end plate 3212, so that docking stability of the first annular portion 3111 and the second annular portion 3211 may be improved, a loosening probability of docking of the first annular portion 3111 and the second annular portion 3211 may be reduced, while a probability of the friction member 33 disengaging from the annular space may also be reduced, and the friction member 33 may be isolated from other components out of the damping assembly 3, so that there is satisfactory mounting stability of the damping assembly 3. Furthermore, the first end plate 3112 and the second end plate 3212 are arranged in parallel, so that smoothness of the first movement member 31 and the second movement member 32 when they rotate relatively may be further increased.

In some embodiments, with reference to FIG. 5 to FIG. 8, the second annular portion 3211 surrounds an outer circumference of the first annular portion 3111, the second end plate 3212 is provided with a through hole **3212*a*, the first connection seat 311 further includes one or more elastic hooks 3113 arranged into an inner space of the first annular portion 3111, an end of the elastic hook 3113 is connected to the first end plate 3112, and another end of the elastic hook 3113 passes through the through hole 3212*a* and is connected to a surface at a side of the second end plate 3212 away from the first end plate 3112**.

The elastic hook 3113 refers to a structure which plays an elastic function and may be deformed.

When the first movement member 31 is docked with the second movement member 32, the friction member 33 is arranged on the outer circumference of the first annular portion 3111, then the through hole **3212*a* of the second annular portion 3211 passes through the elastic hook 3113 from top to bottom, and the elastic hook 3113 is deformed elastically during pass. When the second annular portion 3211 completely surrounds the outer circumference of the first annular portion 3111, the elastic hook 3113 extends out of the through hole 3212*a*, recovers from deformation, and abuts against the side of the second end plate 3212 away from the first end plate 3112, thereby connecting the first connection seat 311 and the second connection seat 321 together, reducing a probability of the second connection seat 321 disengaging from the first connection seat 311, and improving mounting stability of the damping assembly 3**.

The number of elastic hooks 3113 is not limited, and there may be one, two, or more than three elastic hooks. Exemplarily, with reference to FIG. 7, there are three elastic hooks 3113 in number.

In some other embodiments, the first annular portion 3111 surrounds an outer circumference of the second annular portion 3211, the first end plate 3112 is provided with a through hole, the second connection seat 321 includes one or more elastic hooks arranged into an inner space of the second annular portion 3211, an end of the elastic hook is connected to the second end plate 3212, and another end of the elastic hook passes through the through hole and is connected to a surface at a side of the first end plate 3112 away from the second end plate 3212.

In some embodiments, with reference to FIG. 5 to FIG. 8, the first connection seat 311 further includes a limit structure 3114 arranged on the first end plate 3112 and located at an outer circumferential side of the first annular portion 3111, and the limit structure 3114 is configured to form stop-fitting with the second movement member 32 in a circumferential direction, to limit a maximum rotation angle when the second movement member 32 rotates relative to the first movement member 31.

It should be noted that in an initial state, an angle between the first movement member 31 and the second movement member 32 is a first angle, and the initial state is a position where the first movement member 31 and the second movement member 32 are located when the tub assembly 2 is in a stationary state. The second movement member 32 rotates relative to the first movement member 31 when the tub assembly 2 vibrates and deflects, an angle between the second movement member 32 and the first movement member 31 is a second angle when the second movement member 32 abuts against the limit structure 3114, and a maximum rotation angle of the second movement member 32 rotating relative to the first movement member 31 is a difference between the second angle and the first angle. The angle between the first movement member 31 and the second movement member 32 is an angle between a line connecting centers of first and second ends of the first movement member 31 and a line connecting centers of first and second ends of the second movement member 32.

It may be understood that when the tub assembly vibrates and deflects, the first movement member and the second movement member rotate relatively under action of vibration, and when the position of the second movement member rotating relative to the first movement member exceeds a critical position, resistance of the first movement member and the second movement member returning to the initial state is increased greatly, so that the first movement member and the second movement member cannot adaptively move according to variation of the vibration position of the tub assembly, resulting in that vibration of the tub assembly cannot be suppressed effectively, reducing damping reliability of the damping assembly.

In this embodiment, when the second movement member 32 rotates to the maximum rotation angle relative to the first movement member 31, the second movement member 32 forms stop-fitting with the limit structure 3114, and the limit structure 3114 prevents the second movement member 32 from rotating in a direction of increasing the relative rotation angle, to control the angle of the second movement member 32 rotating relative to the first movement member 31 to be within a suitable range, thereby reducing resistance of the first movement member 31 and the second movement member 32 returning to the initial state and improving damping reliability of the damping assembly 3.

In some other embodiments, the limit structure may be arranged at the second connection seat 321, the limit structure is arranged on the second end plate 3212 and located at an outer circumferential side of the second annular portion 3211, and the limit structure is configured to form stop-fitting with the first movement member 31 in a circumferential direction, to limit a maximum rotation angle when the first movement member 31 rotates relative to the second movement member 32.

The clothing treatment device according to the embodiments of the disclosure will be briefly described below with reference to the drawings.

With reference to FIG. 1 to FIG. 8, the first movement member 31 is sleeved on the first rod 4, the second movement member 32 is sleeved on the suspender 6, the first connection portion 313 is sleeved on the first rod 4, the first connection structure 312 is rotationally connected to the first connection portion 313, the first movement member 31 may rotate around the circumferential direction of the first rod 4, slide up and down along the first rod 4 and swing up and down relative to the first rod 4, the second movement member 32 may rotate around the circumferential direction of the suspender 6, and the first movement member 31 and the second movement member 32 may rotate relatively.

In this embodiment, the damping assembly 3 has five movement DOFs in total, i.e., a rotation DOF of rotating around the circumferential direction of the first rod 4, a swing DOF of swinging up and down relative to the first rod 4, a sliding DOF of sliding up and down along the first rod 4, a rotation DOF of rotating around the circumferential direction of the suspender 6, and a DOF of the first movement member 31 and the second movement member 32 rotating relatively. The damping assembly 3 has a low probability of sticking its movement, may adapt to variation of positions when the tub assembly 2 vibrates, and has high damping reliability.

With reference to FIG. 9 to FIG. 12, the first movement member 31 is sleeved on the first rod 4, the second movement member 32 is sleeved on the suspender 6 through the first hole 32*a*, the first movement member 31 may rotate around the circumferential direction of the first rod 4, the second movement member 32 may rotate around the circumferential direction of the suspender 6, slide up and down along the suspender 6 and swing up and down relative to the suspender 6, and the first movement member 31 and the second movement member 32 may rotate relatively.

In this embodiment, the damping assembly 3 has five movement DOFs in total, i.e., a rotation DOF of rotating around the circumferential direction of the first rod 4, a rotation DOF of rotating around the circumferential direction of the suspender 6, a sliding DOF of sliding up and down along the suspender 6, a swing DOF of swinging up and down relative to the suspender 6, and a DOF of the first movement member 31 and the second movement member 32 rotating relatively. The damping assembly 3 has a low probability of sticking its movement, may adapt to variation of positions when the tub assembly 2 vibrates, and has high damping reliability.

With reference to FIG. 13 to FIG. 15, the first movement member 31 is sleeved on the first rod 4, the first movement member 31 may rotate around the circumferential direction of the first rod 4, the connector 322 is sleeved on the suspender 6 and may slide up and down along the suspender 6, the second movement member 32 is sleeved on the connector 322 through the seat sleeve 323, the seat sleeve 323 may swing relative to the connector 322 in omni direction, and the first movement member 31 and the second movement member 32 may rotate relatively.

In this embodiment, the damping assembly 3 has five movement DOFs in total, i.e., a rotation DOF of rotating around the circumferential direction of the first rod 4, a sliding DOF of sliding up and down along the suspender 6, a swing DOF of swinging relative to the connector 322 in omni direction (equivalent to two rotation DOFs), and a DOF of the first movement member 31 and the second movement member 32 rotating relatively. The damping assembly 3 has a low probability of sticking its movement, may adapt to variation of positions when the tub assembly 2 vibrates, and has high damping reliability.

In descriptions of the disclosure, descriptions of reference terms "an embodiment", "some embodiments", "example", "specific example", or "some examples" or the like, mean that specific features, structures, materials or characteristics described in combination with the embodiment or example are included in at least one embodiment or example of the embodiments of the disclosure. In the disclosure, schematic representations of the above terms are not necessarily directed to the same embodiment or example. Furthermore, specific features, structures, materials or characteristics as described may be combined in a suitable manner in any one or more embodiments or examples. Furthermore, those skilled in the art may combine different embodiments or examples described in the disclosure and features of different embodiments or examples, without mutual conflict.

The above descriptions are only preferred embodiments of the disclosure, and are not intended to limit the disclosure. For those skilled in the art, various modifications and variations may be made to the disclosure. Any modification, equivalent replacement, improvement, or the like made within the spirit and principle of the disclosure should be included in the scope of protection of the disclosure.

The invention claimed is:

1. A clothing treatment device comprising:
a housing;
a tub assembly arranged in the housing; and
a damping assembly comprising a first movement member, a second movement member connected to each other and a friction member,
wherein:
an end of the first movement member away from the second movement member is connected to the tub assembly;
an end of the second movement member away from the first movement member is connected to a component out of the tub assembly;
the first movement member and the second movement member are relatively rotatable around a joint;
an axis, around which the first movement member and the second movement member rotate relatively, is substantially parallel to an axis of the tub assembly;
the first movement member comprises a first connection seat, and the second movement member comprises a second connection seat;
the first connection seat comprises a first annular portion, and the second connection seat comprises a second annular portion;
the first annular portion and the second annular portion are nested with each other and provided with an annular space in a radial direction;
the first connection seat further comprises a first end plate connected to the first annular portion, and the second connection seat further comprises a second end plate connected to the second annular portion;
the first end plate and the second end plate are arranged in parallel;
the first annular portion and the second annular portion are located between the first end plate and the second end plate; and
the friction member is arranged in the annular space to provide friction force to achieve damping when the first movement member and the second movement member rotate relatively.

2. The clothing treatment device of claim 1, wherein:
a first end of the first movement member is connected to a first end of the second movement member; and
an angle between a line connecting centers of first and second ends of the first movement member and a line connecting centers of first and second ends of the second movement member does not exceed 180°.

3. The clothing treatment device of claim 1, wherein:
a first end of the first movement member is connected to a first end of the second movement member; and
when the tub assembly is in a stationary state, an angle between a line connecting centers of first and second ends of the first movement member and a line connecting centers of first and second ends of the second movement member is not less than 50° and does not exceed 120°.

4. The clothing treatment device of claim 1, wherein:
a position where the first movement member is connected to the tub assembly is a first position;
a position where the second movement member is connected to the component out of the tub assembly is a second position; and
in a planar projection perpendicular to a height direction of the clothing treatment device, when the tub assembly is in a stationary state, a line connecting centers of projections of the first position and the second position is substantially perpendicular to a tangent line of the tub assembly at the first position.

5. The clothing treatment device of claim 1, wherein:
the clothing treatment device further comprises a first rod and a second rod;
the first rod is fixed to an outer circumferential side of the tub assembly;
the end of the first movement member away from the second movement member is connected to the first rod; and
the end of the second movement member away from the first movement member is connected to the second rod.

6. The clothing treatment device of claim 5, wherein:
the end of the first movement member away from the second movement member is rotatable around a circumferential direction of the first rod; and/or
the end of the second movement member away from the first movement member is rotatable around a circumferential direction of the second rod.

7. The clothing treatment device of claim 5, further comprising at least one suspender,
wherein:
an end of the at least one suspender is connected to the tub assembly, and another end of the at least one suspender is connected to the housing, so that the tub assembly is suspended from the housing by the at least one suspender;
the second rod is a part of the at least one suspender or the second rod is connected to the at least one suspender.

8. The clothing treatment device of claim 5, further comprising an operation platform arranged at a top end of the housing, wherein an end of the second rod is connected to the operation platform, and another end of the second rod extends downward from the operation platform.

9. The clothing treatment device of claim 5, further comprising a mounting seat arranged at an inner side of the housing, wherein at least one end of the second rod is arranged on the mounting seat.

10. The clothing treatment device of claim 5, wherein one of the first movement member and the second movement member has a degree of freedom of moving in an up-down direction.

11. The clothing treatment device of claim 5, wherein one of the first movement member and the second movement member has a degree of freedom of swinging up and down.

12. The clothing treatment device of claim 1, wherein the second annular portion surrounds an outer circumference of the first annular portion, the second end plate is provided with a through hole, the first connection seat further comprises one or more elastic hooks arranged into an inner space of the first annular portion, an end of the one or more elastic hooks is connected to the first end plate, and another end of the one or more elastic hooks passes through the through hole and is connected to a surface at a side of the second end plate away from the first end plate.

13. The clothing treatment device of claim 1, wherein the first annular portion surrounds an outer circumference of the second annular portion, the first end plate is provided with a through hole, the second connection seat further comprises one or more elastic hooks arranged into an inner space of the second annular portion, an end of the one or more elastic hooks is connected to the second end plate, and another end of the one or more elastic hooks passes through the through hole and is connected to a surface at a side of the first end plate away from the second end plate.

14. The clothing treatment device of claim 1, wherein the first connection seat further comprises a limit structure arranged on the first end plate and located at an outer circumferential side of the first annular portion, and the limit structure is configured to form stop-fitting with the second movement member in a circumferential direction, to limit a maximum rotation angle when the second movement member rotates relative to the first movement member.

15. The clothing treatment device of claim 1, wherein the second connection seat further comprises a limit structure arranged on the second end plate and located at an outer circumferential side of the second annular portion, and the limit structure is configured to form stop-fitting with the first movement member in a circumferential direction, to limit a maximum rotation angle when the first movement member rotates relative to the second movement member.

* * * * *